US010835881B2

(12) United States Patent
Putrino

(10) Patent No.: US 10,835,881 B2
(45) Date of Patent: Nov. 17, 2020

(54) MIXING DEVICE AND METHODS THEREOF

(71) Applicant: Roy C. Putrino, Wyckoff, NJ (US)

(72) Inventor: Roy C. Putrino, Wyckoff, NJ (US)

( * ) Notice: Subject to any disclaimer, the term of this patent is extended or adjusted under 35 U.S.C. 154(b) by 0 days.

(21) Appl. No.: 15/869,026

(22) Filed: Jan. 11, 2018

(65) Prior Publication Data

US 2018/0200685 A1 Jul. 19, 2018

Related U.S. Application Data

(60) Provisional application No. 62/445,215, filed on Jan. 11, 2017.

(51) Int. Cl.
*B01F 15/00* (2006.01)
*A61J 1/20* (2006.01)
*B01F 13/00* (2006.01)

(52) U.S. Cl.
CPC ..... *B01F 15/0087* (2013.01); *A61J 1/2093* (2013.01); *B01F 13/0022* (2013.01); *B01F 2215/0032* (2013.01)

(58) Field of Classification Search
CPC ..... B01F 15/0087
USPC ..... 366/130; 220/568; 206/219, 221, 222; 604/87
See application file for complete search history.

(56) References Cited

U.S. PATENT DOCUMENTS 462,990 A * 11/1891 Oppenheimer ..... A61K 9/4858 424/451
3,321,097 A * 5/1967 Solowey ..... B65D 1/04 206/221
3,856,138 A * 12/1974 Maekawa ..... B65D 81/3222 206/221
4,695,272 A * 9/1987 Berglund ..... A61M 5/1409 604/252
8,323,713 B1 * 12/2012 Selman ..... A23L 2/54 426/118
2003/0023203 A1 * 1/2003 Lavi ..... A61J 1/2089 604/82
2008/0277310 A1 * 11/2008 Chacon ..... B65D 77/062 206/568
2009/0211927 A1 * 8/2009 Wu ..... B65D 81/3222 206/219
2009/0294397 A1 * 12/2009 Wu ..... B65D 81/3222 215/6
2011/0272302 A1 * 11/2011 Pagan ..... B65D 81/3283 206/222
2013/0201782 A1 * 8/2013 Ruff ..... A47G 23/0241 366/130
2015/0050405 A1 * 2/2015 Trager ..... B65D 81/3211 426/519

* cited by examiner

*Primary Examiner* — David L Sorkin
(74) *Attorney, Agent, or Firm* — Gearhart Law LLC

(57) ABSTRACT

A mixing device and methods of utilizing the same. More specifically, embodiments of the present disclosure relate to a mixing device that may be used to make medications and specialized pharmaceuticals for administration via intrathecal infusion therapy, or the like. A mixing device may comprise an upper chamber, a lower chamber having four compartments for accepting an amount of medication, wherein the upper chamber and the lower chamber may be coupled and may be used to mix and make medication accessible via a Luer Lock adapter, termination, or the like, wherein the device is in compliance with USP 797 standards.

10 Claims, 35 Drawing Sheets

1B

6

30

60

70

MIXING DEVICE AND METHODS THEREOF

CROSS-REFERENCE TO RELATED APPLICATIONS

The present application claims priority to U.S. Provisional Patent Application Ser. No. 62/445,215 entitled "MIXING DEVICE AND METHODS THEREOF," filed Jan. 11, 2017, the disclosure of which is incorporated herein by reference in its entirety.

BACKGROUND

Field of the Invention

Embodiments of the present disclosure are generally related to a mixing device and methods of utilizing the same. More specifically, embodiments of the present disclosure relate to a mixing device that may be used to make medications and specialized pharmaceuticals for administration via intrathecal infusion therapy, or the like.

Description of Related Art

Embodiments of the present invention are designed and adapted to be in compliance with United States Pharmacopeia and the National Formulary (USP-NF) standards. Millions of prescriptions are compounded by pharmacists, nurses, and doctors each year in the US to meet the unique needs of patients who otherwise may not have access to the required medicine in the right concentration or dosage. Understanding of the risks inherent in compounding and incorporating established United States Pharmacopeial Convention (USP) standards into everyday practice is essential for patient safety.

USP General Chapter <797> for "Sterile Compounding" describes a number of requirements, including responsibilities of compounding personnel, training, facilities, environmental monitoring, and storage and testing of finished preparations. USP <797> helps to ensure patients receive quality preparations that are free from contaminants and are consistent in intended identity, strength and potency. It describes a number of requirements, including responsibilities of compounding personnel, training, environmental monitoring, storage and testing of finished preparations.

USP is a nonprofit scientific organization founded in 1820 in Washington, D.C., that develops and disseminates public compendial quality standards for medicines and other articles. USP's mission is "to improve global health through public standards and related programs that help ensure the quality, safety, and benefit of medicines and foods."

USP has an established process for convening independent experts in the development and maintenance of healthcare quality standards. The process is public health focused, leveraging current science and technology, and draws on the expertise of scientists and healthcare practitioners while providing opportunities for public input from stakeholders throughout the standards' progress. USP standards may be adapted or adopted by any organization or government worldwide.

Understanding the risks inherent in sterile compounding and incorporating established standards are essential for patient safety. Compounded drugs made without the guidance of standards may be sub-potent, super potent or contaminated, exposing patients to significant risk of adverse events or even death.

USP develops standards for preparing compounded sterile drugs to help ensure patient benefit and reduce risks such as contamination, infection or incorrect dosing. An article of commerce that is recognized in the USP-NF complies with USP-NF standards when it meets all of the requirements stated in the article's monograph, applicable General Chapters, and the General Notices. Applicable standards apply at all times in the life of an article, from production to expiration. Thus, any official article is expected to meet the compendial standards if tested, and any official article actually tested as directed in the relevant monograph must meet such standards to demonstrate compliance. Frequency of testing and sampling are left to the preferences or direction of those performing compliance testing, and other users of USP-NF, including manufacturers, buyers, or regulatory authorities.

There exists no devices available for the provision of Intrathecal delivery of powdered drugs that are in compliance with USP, which are preservative free. Home infusion is a highly specialized area of medicine that includes intrathecal therapies, including intrathecal pump refills, dose adjustments, refills at home, bridge bolus, dose titrations, and the like. A need exists for a device to aid in providing high quality and cost effective home infusion and intrathecal therapies in compliance with USP 797 standards.

SUMMARY

Embodiments of the present disclosure are generally related to a mixing device and methods of utilizing the same. More specifically, embodiments of the present disclosure relate to a mixing device that may be used to make medications and specialized pharmaceuticals for administration via intrathecal infusion therapy, or the like. In one embodiment, a mixing device may comprise an upper chamber, a lower chamber having four compartments for accepting an amount of medication, wherein the upper chamber and the lower chamber may be coupled and may be used to mix and make medication accessible via a Luer Lock adapter, termination, or the like, wherein the device is in compliance with USP 797 standards.

BRIEF DESCRIPTION OF THE DRAWINGS

So the manner in which the above-recited features of the present disclosure can be understood in detail, a more particular description of embodiments of the present disclosure, briefly summarized above, may be had by reference to embodiments, which are illustrated in the appended drawings. It is to be noted, however, the appended drawings illustrate only typical embodiments of embodiments encompassed within the scope of the present disclosure, and, therefore, are not to be considered limiting, for the present disclosure may admit to other equally effective embodiments, wherein.

Figure 1:
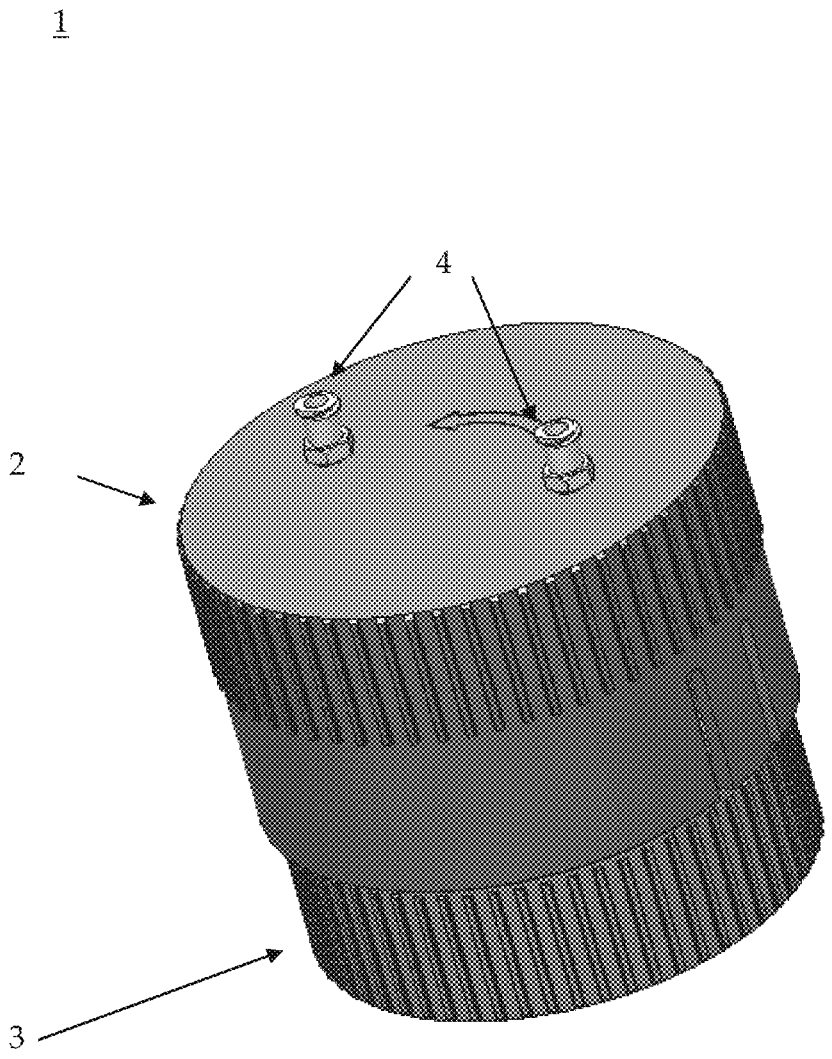
FIGS. 1 and 2 depict various views of a relatively short and wide version of the mixing device in accordance with embodiments of the present disclosure.

The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include", "including", and "includes" mean including but not limited to. To facilitate understanding, like reference numerals have been used, where possible, to designate like elements common to the figures.

DETAILED DESCRIPTION

Embodiments of the present disclosure are generally related to a mixing device and methods of utilizing the same. More specifically, embodiments of the present disclosure relate to a mixing device that may be used to make medications and specialized pharmaceuticals for administration via intrathecal infusion therapy, or the like. Although the examples described herein generally relate to mixing medications, pharmaceuticals, or the like, it is contemplated by and within embodiments of the present disclosure that devices described herein may be used to mix any substances suitable for storage in the containers described herein.

Intrathecal infusion therapy may typically be performed with the use of a needle or catheter. Some medications administered via IV therapies may be called "specialty pharmaceuticals." Specialty pharmaceuticals may include drugs and biologics that are complex to manufacture, can be difficult to administer, and often require special patient monitoring. The processes of mixing and making specialty pharmaceuticals is sometimes completed in compounding pharmacies and is often not consistent from pharmacy to pharmacy.

There are currently 8 drugs used for this therapy, which includes pain and spasticity. Of the eight drugs only 3 are approved by the U.S. Food and Drug Administration ("FDA") for the pump and available commercially. The other 5 are considered "Off Label", and when mixed with any of the approved drugs then that compound is considered "Off Label". The term "Off Label" means that the drugs are FDA approved, but may be a different strength, route or use that was indicated by the FDA. As a result, many compounding pharmacies across the United States have been manufacturing these drugs at their sites.

The U.S. Pharmacopeial Convention (USP) is a scientific nonprofit organization that sets standards for the identity, strength, quality, and purity of medicines, food ingredients, and dietary supplements manufactured, distributed and consumed worldwide. The United States Pharmacopeia and The National Formulary (USP-NF) is a book of public pharmacopeial standards for chemical and biological drug substances, dosage forms, compounded preparations, excipients, medical devices, and dietary supplements. "USP 797" or the "797 Standards" refers to chapter 797 "Pharmaceutical Compounding—Sterile Preparations," in the USP National Formulary.

The 797 Standards were developed due to issues with compounding of other therapies. The 797 Standards include the minimum practices and quality standards to be followed when preparing compounded sterile human and animal drugs (compounded sterile preparations, or CSPs). These practices and standards must be used to prevent harm, including death, to human and animal patient that could result from 1) microbial contamination (nonsterility), 2) excessive bacterial endotoxins, 3) variability from the intended strength of correct ingredients, 4) chemical and physical contaminants, and/or 5) use of ingredients of inappropriate quality.

Although the IT Therapy is really non-applicable to the 797 Standards, due to its double sterilization prior to use, it is often held to the guidelines. As different interpretations of the standards by different pharmacies and even be different pharmacists in the same pharmacy, the products often varied a great deal. These variations often caused erratic changes in the patient status and causes many issues in controlling and stabilizing the therapy. Patients can experience withdraws from under potent mixtures or overdoses (possibly death) from over potent mixtures. The patient cannot even be assured that a refill will provide an identical response as the previous or the next dose.

Also, based on the preparation method (the compounding), the drug may expire sooner leaving the patient without drug for days or even weeks. Since there are no set expiration dates these compounds many pharmacies are left to guess. Adding insult to injury, the physician often would want to wait until the total volume is used before allowing the refill, which means that the drug most likely expired before the refill. In this case, patients are usually shocked at the point of the next refill when they get the full dose again.

Most physicians like to order the drug a month in advance and leaves the completed compound sitting in the office perhaps in a closet or draw and if placed in a refrigerator then most likely with food. This procedure decreases the drugs expiration date and subjects the syringe to contamination.

IT therapy is a use of embodiments of the present disclosure. Embodiments of the present disclosure are designed to exceed the 797 Standards by allowing the drug to be administered minutes after preparation. The 797 standards limit the use to 24 hours at room temperature or 72 hours refrigerated and normally this would have to include the time to transport and/or mail the product. By using embodiments of the present disclosure, the drug may be administered far before the 24 hour requirement. For Intrathecal administration, drugs must be preservative-free, unlike IV drugs which contain preservatives for extending the life of the drug.

The sterilization process is the when the clock of the 797 Standards begins and the drug must be used within the time period, unless clinical data can supports extending the USP dating. Devices in accordance with the present disclosure may provide sterilization of the product twice (for example, once when extracting the drug from the device and again when the drug is instilled in the pump).

This device intended to only be delivered to a clinician (MD or RN) trained in the use of the device. Due to its high opiate content and preservative-free solution, it may be required to always be under a controlled environment before use.

The use of implanted pumps for pain may be useful in the fight against opiate abuse. The drug may be instilled into the pump by a professional and may not provide any access for the patient to resell or abuse the product. In addition, the short half-life (30 to 60 days) may ensure that drugs cannot be stock piled for any extended time, as compared to orals which can last for years. In exemplary embodiments, a refill kit may also be provided for the procedure specific for the pump that is currently being used, or the like.

While many specialty pharmaceuticals may be administered at a hospital or other medical facility, a number of specialty pharmaceuticals may be administered at a patient's home. The process of administering medication, or the like, via IV at a user's home process may be referred to as "home infusion" or "home intrathecal infusion." Intrathecal administration may include a route of administration via an injection, or the like, into the spinal canal, or into the subarachnoid space so that it reaches the cerebrospinal fluid (CSF). Some home intrathecal infusion patients rely on intrathecal pumps, or the like, to deliver medications directly to the spinal column to help with chronic pain and/or spasticity. An intrathecal pump is a specialized device, which delivers concentrated amounts of medication into spinal cord area through an intrathecal catheter, or the like. In the case of home intrathecal infusion patients, pharmaceuticals are prepared for these pumps and for other infusion therapies, in a remote location and shipped or transported to the patient's location to be administered.

Numerous inconsistent methods of preparing these medications or specialized pharmaceuticals exist and there is little consistency of preparation methods in the industry. The shipping process for specialized pharmaceuticals may also be inconsistent. Due to these inconsistencies in preparation and shipment of the medications, different patients may receive different compositions. For example, different preparation methods may affect medications in ways not contemplated by the prescribing healthcare provider and may decrease the efficacy of the prescribed medication. The compositions may also be shipped in inconsistent containers having different temperatures and/or ambient conditions. The compositions may also be handled differently and more or less cautiously by each shipping carrier. Inconsistent methods of preparation may also increase the likelihood of human error, due to the lack of a standardized preparation procedure.

A device in accordance with the present disclosure is a closed system that eliminates and/or supersedes the USP 797 standards for compounding, allowing local pharmacies to distribute the medications without all the necessary policy, procedure and equipment required to meet the current standards. The USP-NF book and USP 797 is incorporated herein by reference in its entirety as if fully set forth herein.

Due to these inconsistencies, the efficacy of the resulting medications and patient outcomes may be negatively affected. As such, by skipping the shipping process, and preparing these medications at the patient's home or bedside in a consistent manner, using a consistent device, may result in more consistent and effective results from the medication. Thus, a need exists for a device and a method of making medications, specialty pharmaceuticals, or the like, that improves consistency and allows a composition to be made in close proximity to where it will be administered.

FIGS. 1-35 depict various views of a mixing device in accordance with embodiments of the present disclosure. A mixing device may comprise an upper chamber; and a lower chamber, the lower chamber having at least two compartments for accepting an amount of medication; wherein the upper chamber and the lower chamber may be coupled and may be used to mix and make medication; and wherein the device is in compliance with USP 797 standards.

The lower chamber may be separated into separate compartments, or the like. For example the lower chamber may be separated into three, four, five, or six compartments, each adapted to hold between 0-3 grams of powder, or the like. Alternative sized compartments and compartments of a non-uniform and/or adjustable size are contemplated by and within the present disclosure. In some embodiments, the lower chamber comprises four compartments for accepting an amount of medication. In some embodiments, the medication may be accessible via a Luer port, or the like. In some embodiments, the medication is mixed by shaking the device after the upper chamber and the lower chamber are coupled together. In some embodiments, an operator would load a respective powder in one, two, three, four, or five chambers that would be mixed with a liquid, either preloaded in the upper chamber or inserted via a Luer port. In some embodiments, the upper chamber may comprise one or more ports for Luer fittings, or the like. In some embodiments, o-rings or other fittings may be used to ensure the device does not leak and remains in compliance with USP 797 standards. In some embodiments, the upper chamber may comprise cantilever snaps to lock the upper chamber in place when coupled with the lower chamber, or the like.

In operation, a user would insert powder into one or more compartments and alight the upper chamber with the lower chamber for coupling. The upper chamber and lower chamber would then be slid and locked into position, so that no powder would be able to escape the compartments they are disposed in. In some embodiments, the powder compartments are prevented from mixing with each other and covered by the upper chamber. The upper chamber comprises ports that may be blocked by the lower chamber, thereby preventing any powder from escaping the device and any foreign materials from entering either chamber.

Figure 2:
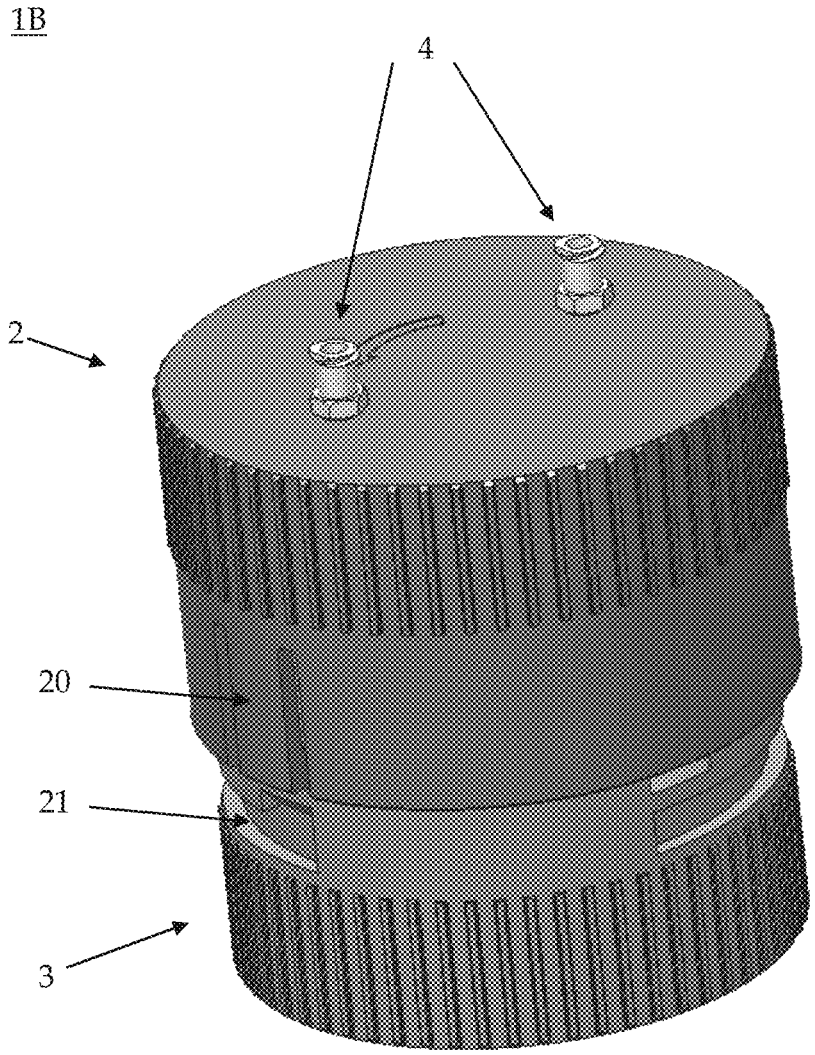
Figure 3:
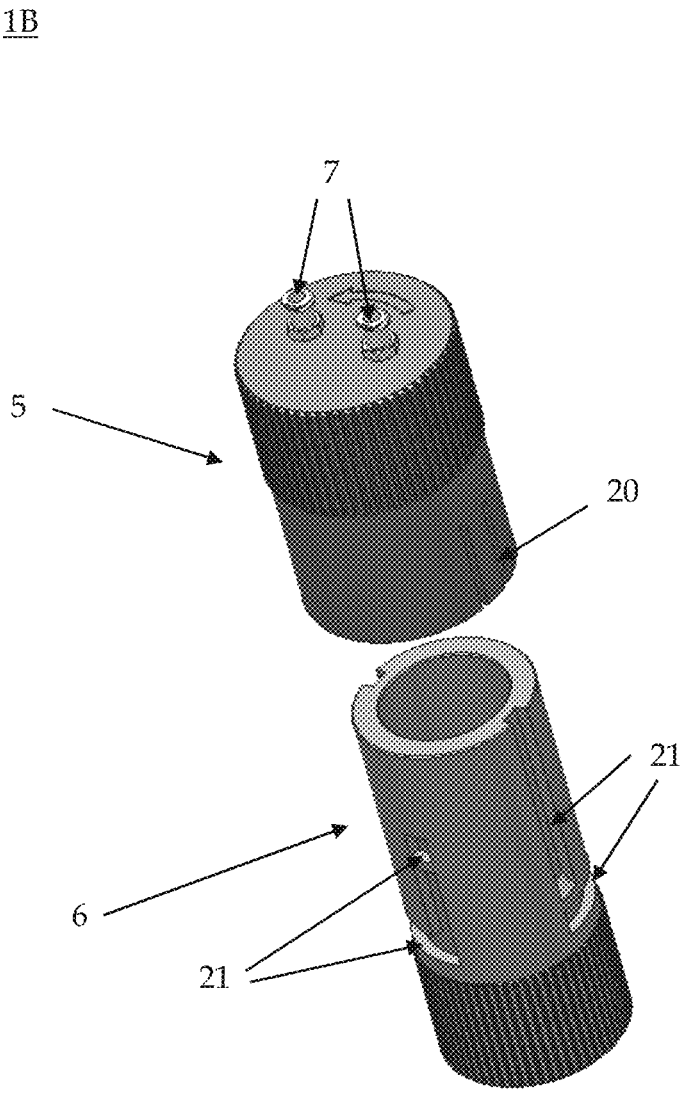
FIGS. 3-5 depict various views of a relatively taller and narrower mixing device in accordance with embodiments of the present disclosure.
Figure 4:
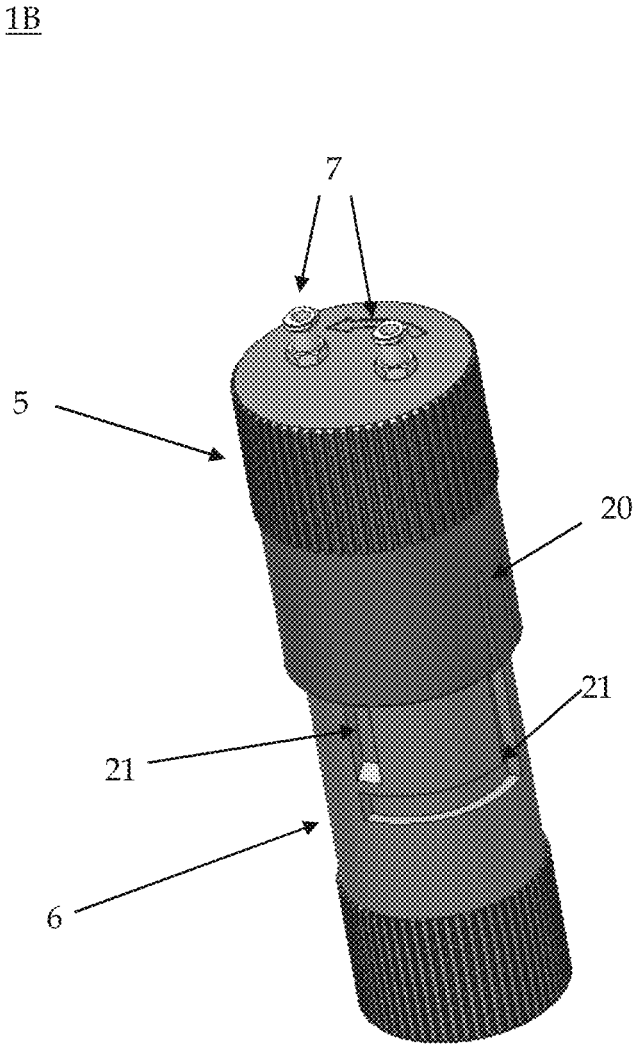
Figure 5:
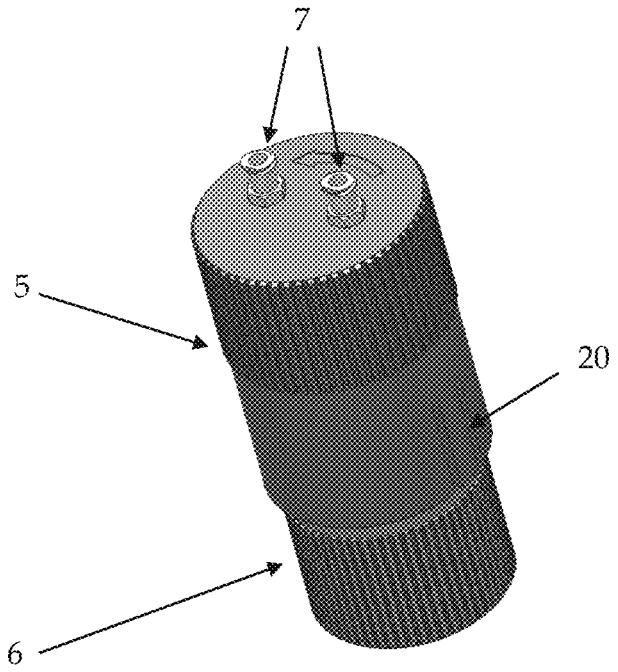

FIGS. 1-12 depict various views of a mixing device in accordance with one embodiment of the present disclosure. FIGS. 1 and 2 show a mixing device comprising: an upper chamber 2, and a lower chamber 3, whereas FIGS. 3-5 show a mixing device comprising an upper chamber 5 and a lower chamber 6. The device shown in FIGS. 1 and 2 is a shorter and wider version of the device shown in FIGS. 3-5, however, both devices depicted share the same components. The figures are included to show embodiments of different dimensions.

Figure 7:
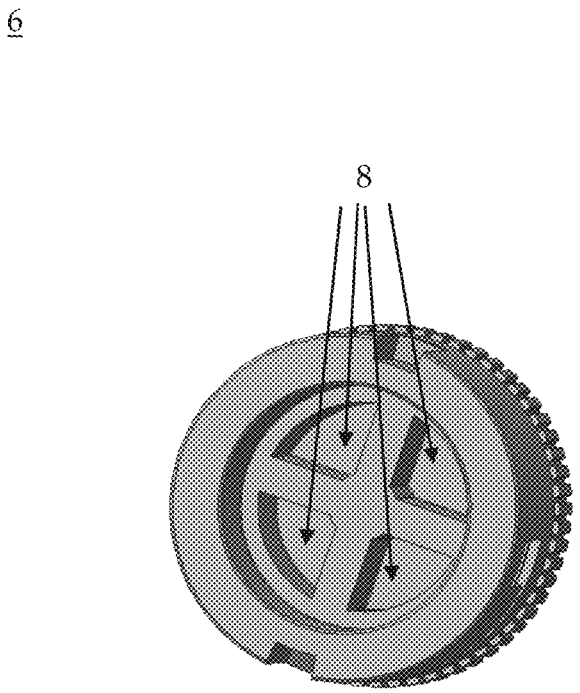
Figure 8:
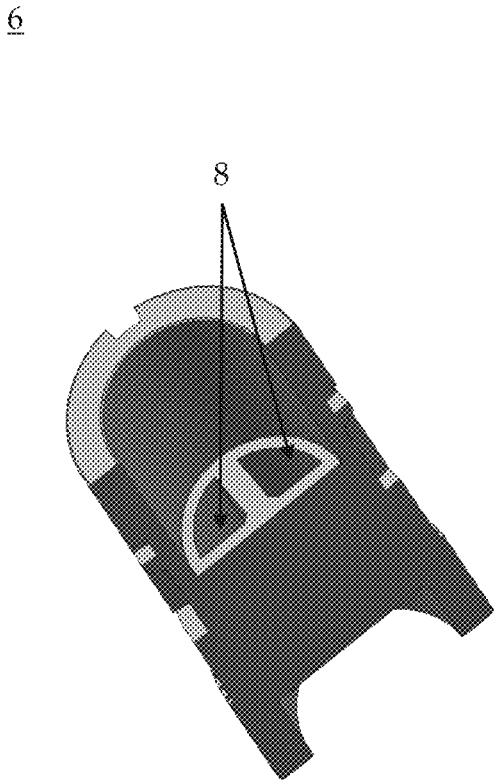
Figure 9:
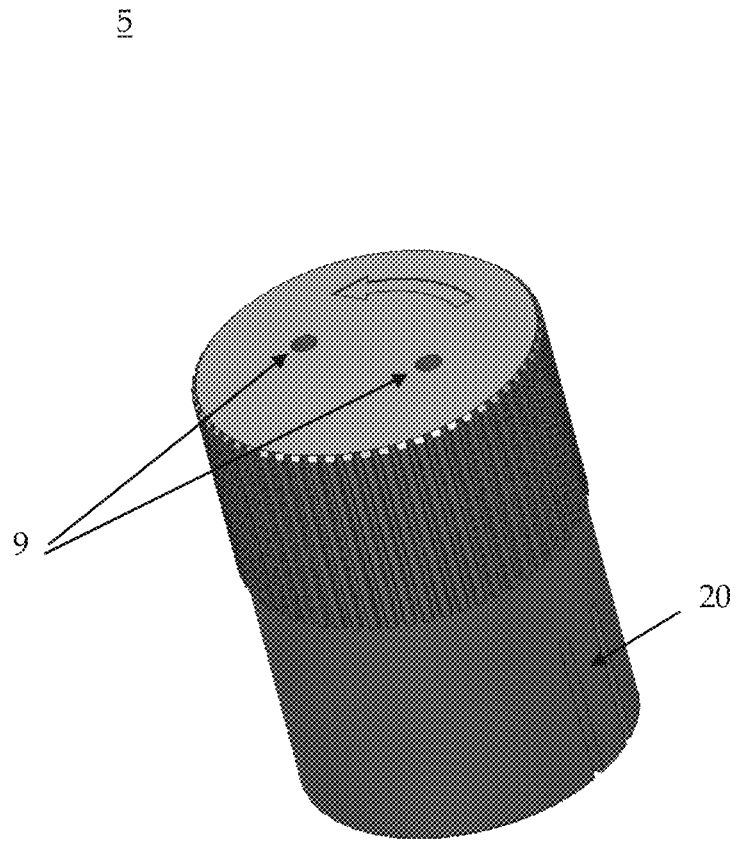
FIGS. 9-10 illustrate details of the upper chamber of the mixing device in accordance with embodiments of the present disclosure.
Figure 10:
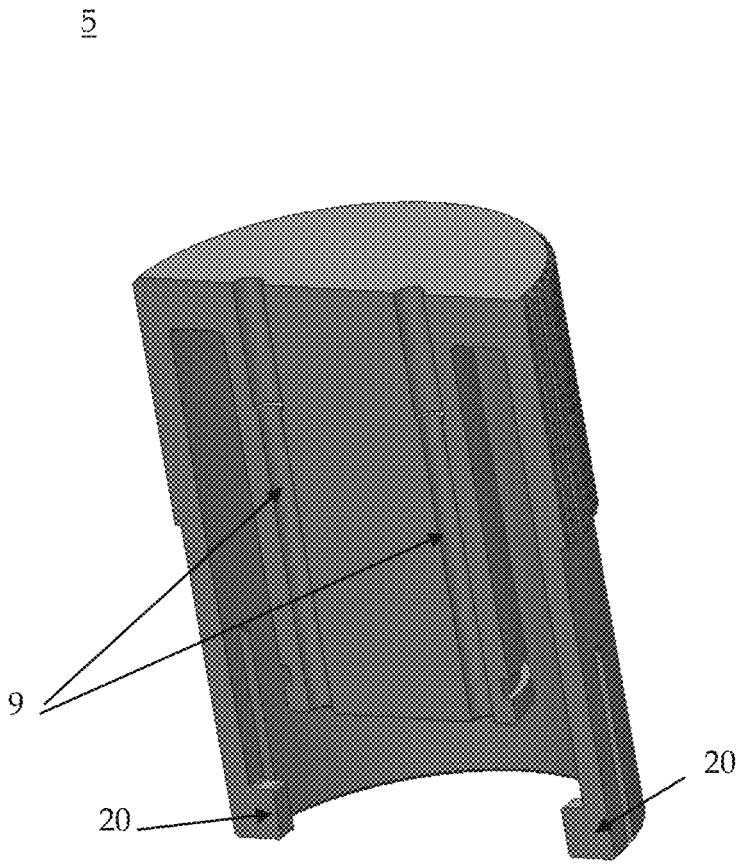
Figure 11:
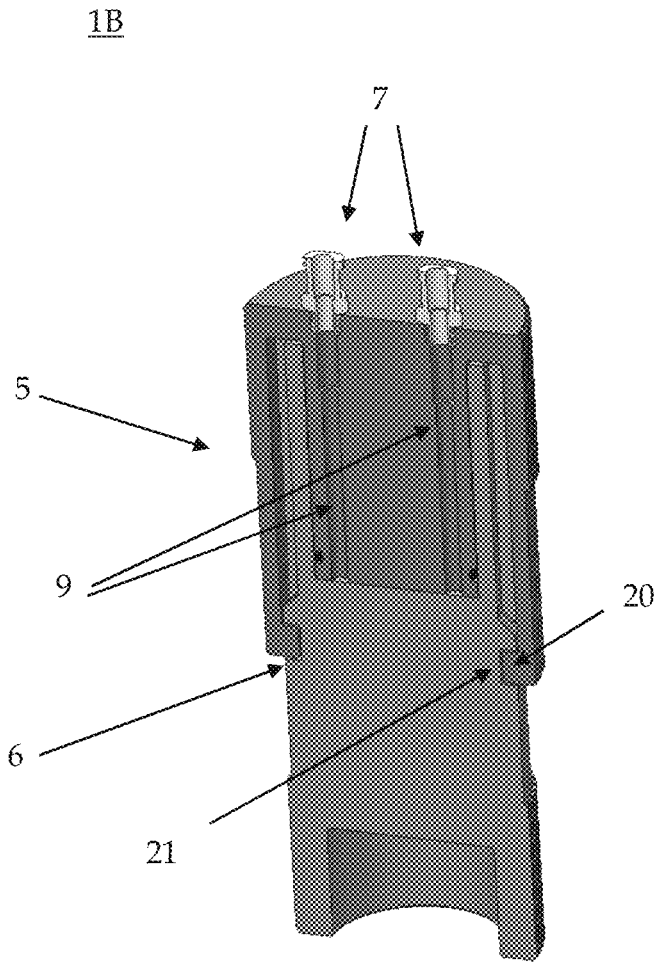
FIGS. 11-12 illustrate the internal structure of the upper and lower chambers of the mixing device in accordance with embodiments of the present disclosure.
Figure 12:
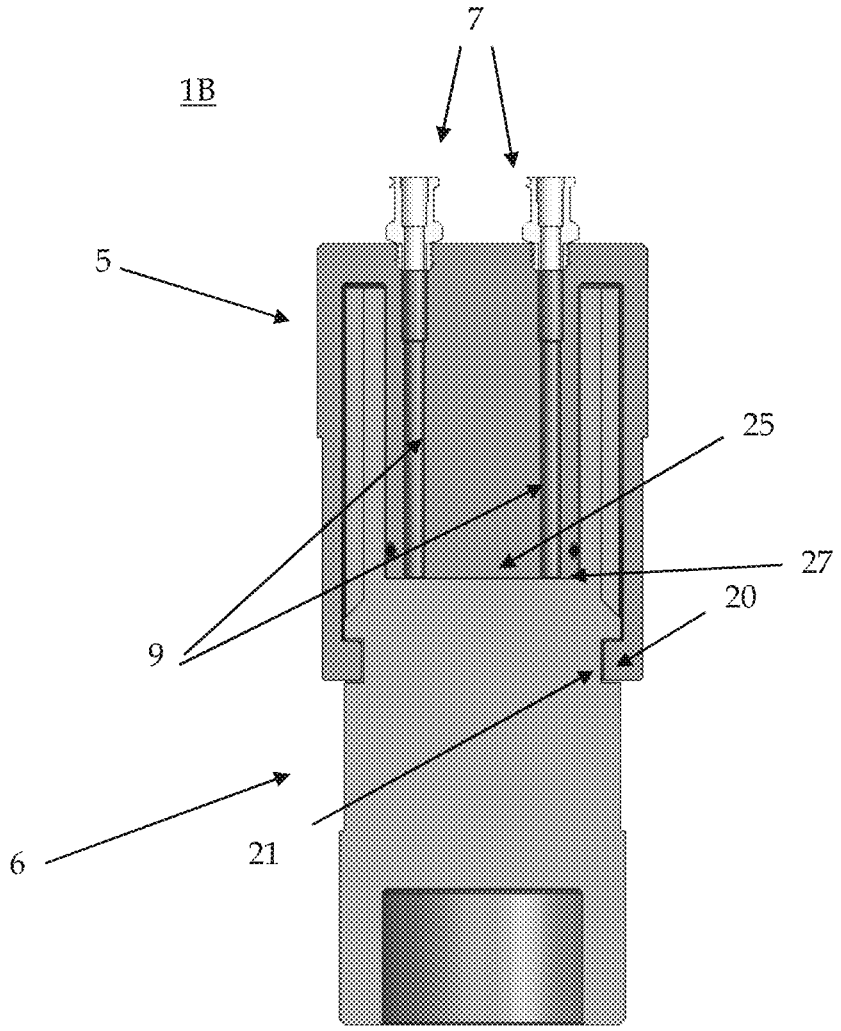
Figure 13:
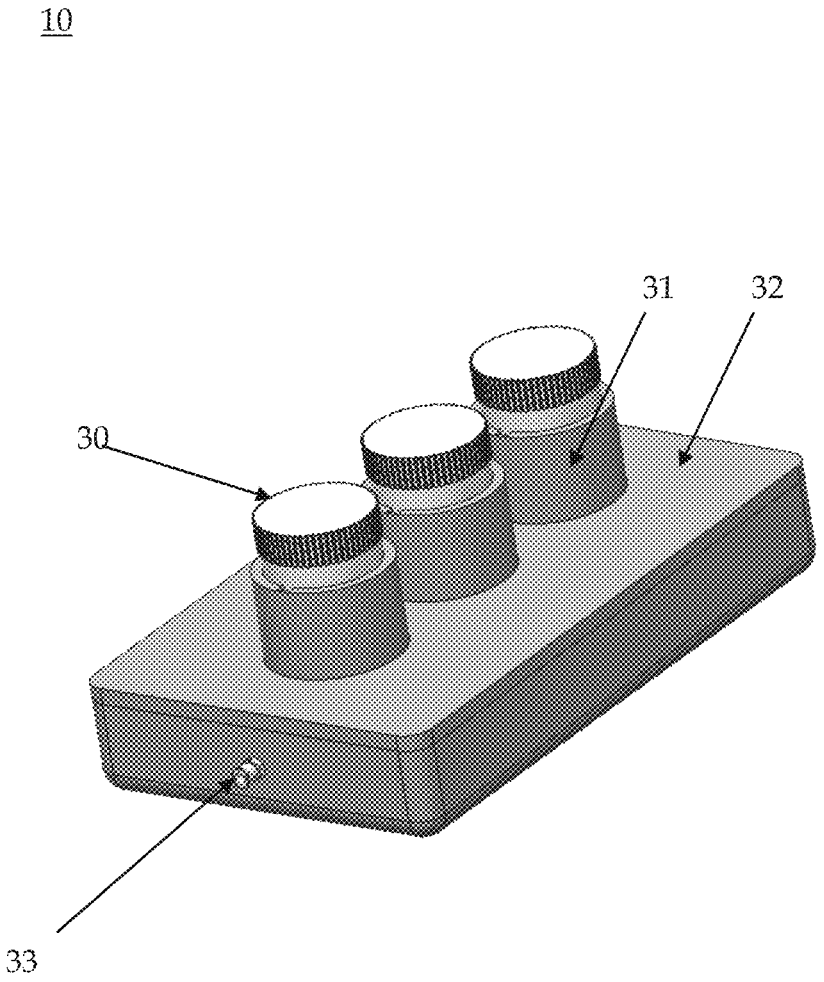
FIG. 13 is a perspective view of a mixing device in accordance with another embodiment of the present disclosure.
Figure 14:
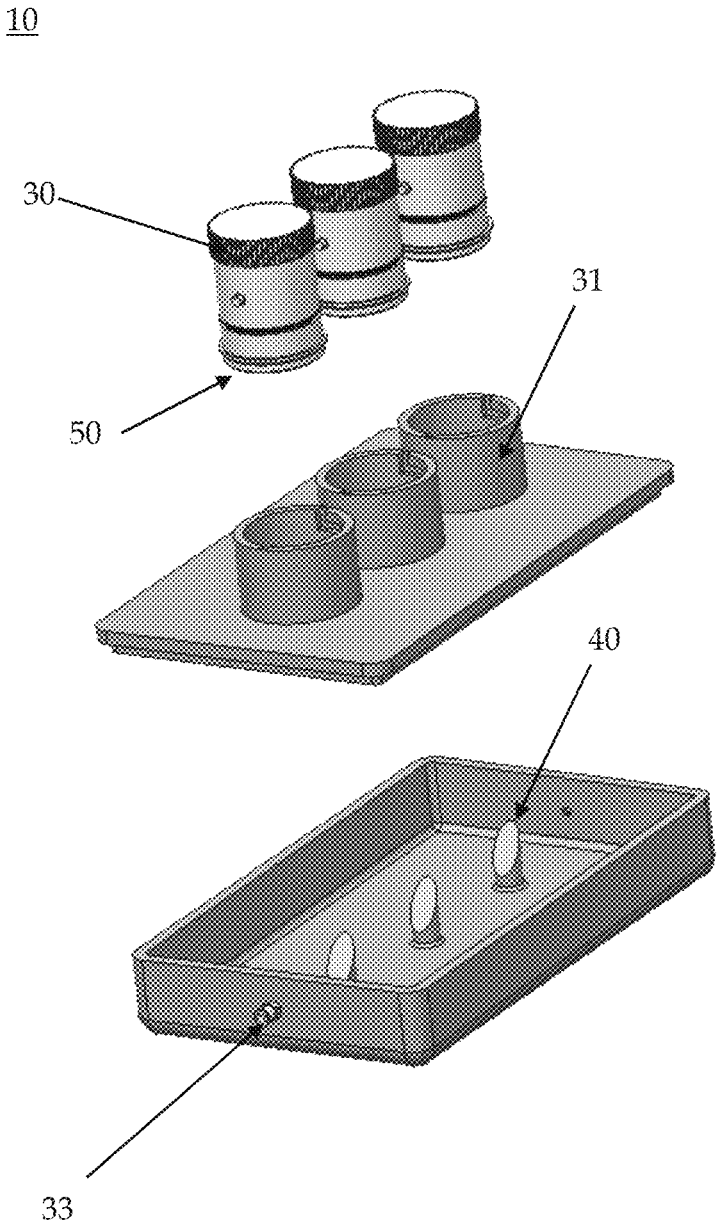
FIG. 14 is an exploded view of the embodiment of FIG. 13.
Figure 15:
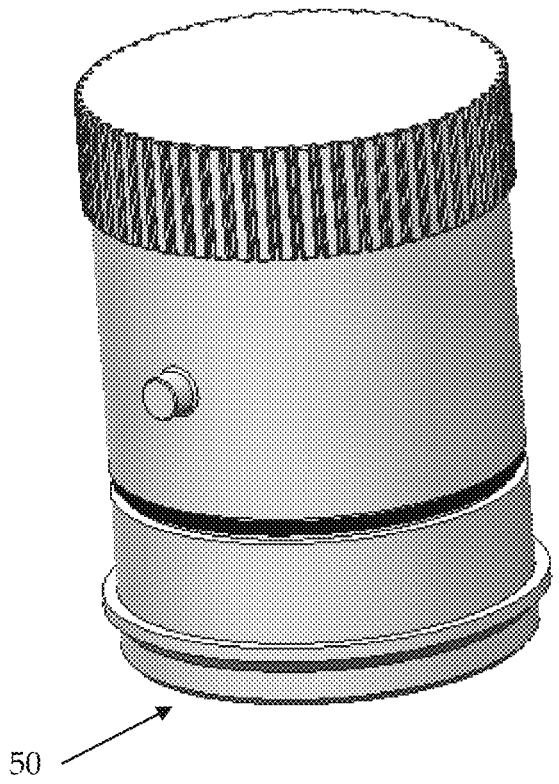
FIGS. 15 and 16 are perspective views of the storage cylinders used in the embodiment of FIG. 13.
Figure 16:
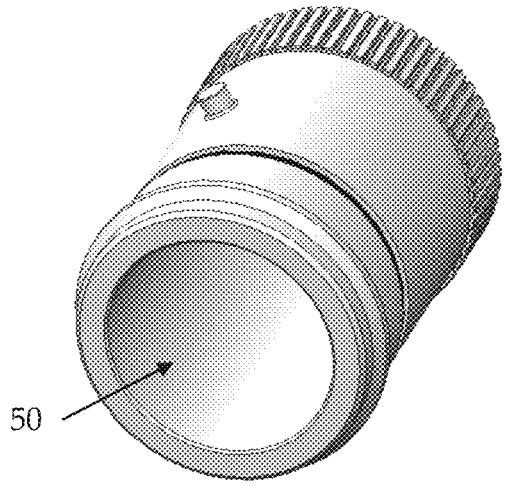

The lower chambers 3, or 6 have at least two compartments or cavities 8, as shown in FIGS. 7 and 8, for accepting an amount of medication; wherein the upper chambers 2, or 5 may be coupled to their respective the lower chambers 3, or 6 and may be used to mix and make medication; and wherein the device is in compliance with USP 797 standards. For example, the lower chambers 3, or 6 may comprise four compartments or cavities 8, as shown in FIGS. 7 and 8, for accepting an amount of medication. Subject to the space requirements of the chamber, any number of compartments or cavities 8 adapted to hold medication, or the like, may be included. The mixing device of FIGS. 1 and 2 may comprise ports 4, and the mixing device of FIGS. 3-5 may comprise ports 7, for extracting mixed medication and/or allowing air to pass there through via channels 9, as shown in FIGS. 9-12, or the like. The ports 4, 7 may be a Luer port, or the like. In some embodiments, only one port may be used. In some embodiments, more than two ports may be used.

In operation, the medication is placed into the compartments or cavities 8 in the lower chambers 3 or 6, and the upper chamber 2, or 5 is coupled with the respective lower chamber 3, or 6. In some embodiments, a portion of the upper chamber 2, or 5, is formed to couple with a portion of the lower chamber 3, 6. For example, as shown in FIGS. 2-5, and 9-12, the upper chamber 2, or 5, may include tabs or protrusions 20 formed to couple with recesses 21 formed in the lower chamber 3, or 6, as shown in FIGS. 2-4, 6, 11 and 12, or the like. In some embodiments, the protrusions 20 may slide downward toward a bottom portion of the lower chamber 3, 6 into a first locked position, thereby effectively securing the device and securing the upper chamber 2, or 5 to the respective lower chamber 3, or 6. This first locked position may allow the device to be transported and a portion 25 (shown in FIG. 12) of the upper chamber 2, or 5 may completely block all compartments 8, thereby retaining any medication that has been inserted therein. When a user is ready to use the device to mix the medication, the upper chamber 2, or 5 may be slid into a second position wherein the compartments 8 are uncovered and allowed to mix together in an area 27 (also shown in FIG. 12) formed between the respective upper chamber 2, or 5 and the lower chamber 3, or 6 after the blocking portion 25 is lifted upward.

Figure 6:
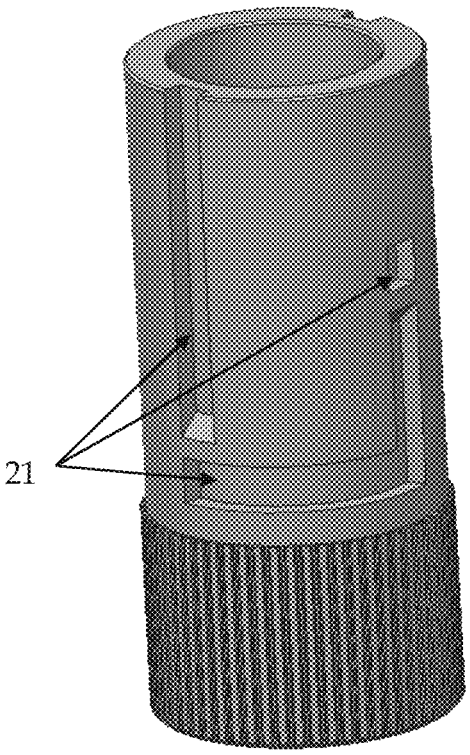
FIGS. 6-8 illustrate details of the lower chamber of the mixing device in accordance with embodiments of the present disclosure.

As best illustrated with reference to FIGS. 3, 4 and 6, the upper chamber 2, or 5, may be rotated and the protrusions 20 may slide horizontally around the circumference of the respective lower chamber 3, or 6 via the recesses 21, or the like and then pulled upward until it reaches a second position, where the protrusions 20 are secured in place via a an opening that restricts movement of the protrusions 20 vertically and/or horizontally. When the upper chamber 2, or 5 is coupled and secured to the respective lower chamber 3, or 6, the device is ready for the mixing step. The medication may then be mixed by shaking the device after the upper chamber and the lower chamber are coupled together.

In some embodiments, when in use and to prepare for home infusion, or the like, the user may rotate and pull the upper chamber or cap to a secondary lock position, thereby opening the compartments. The device can then be manipulated or shaken such that the powders will mix. A liquid may then be inserted via the upper chamber into a port to mix with the powders inside the device. The device may then be shaken or otherwise agitated to effectuate mixing of the medications.

In some embodiments, the mixing device may be formed in the shape of a puck-like design. In some embodiments, a puck that carries the powder may be used and may comprise a knurled end, a locating post, an annular snap, an o-ring, and/or the like. A seal material may cover the end of the puck, or the like. The seals must be pharmaceutical grade. An o-ring may be employed to prevent leakage of the medication, the powder, the liquid, and/or the like. The puck may be designed to be inseparable from the mixing device after coupling with the mixing device, to prevent reuse and force disposal after use. In some embodiments one or more Luer lock tapered terminations may be used to make leak-free connections. In some embodiments piercing posts may be present in the mixing device and may pierce the seal material and allow the powder to enter a mixing chamber of the mixing device. In some embodiments, the mixing device may be ultrasonic welded. In some embodiments, the mixing device may comprise a circumferential groove for the locating post on either side and annular snaps for a locked and unlocked position. The mixing device may comprise various positions, such as a load position and a puncture position. Stepped locks, such as a load lock and a puncture lock, may be included. Lock snaps may be used to couple the puck with the mixing device. In some embodiments, a puncture post may be included that may comprise a single post or a double post, or the like.

Figure 17:
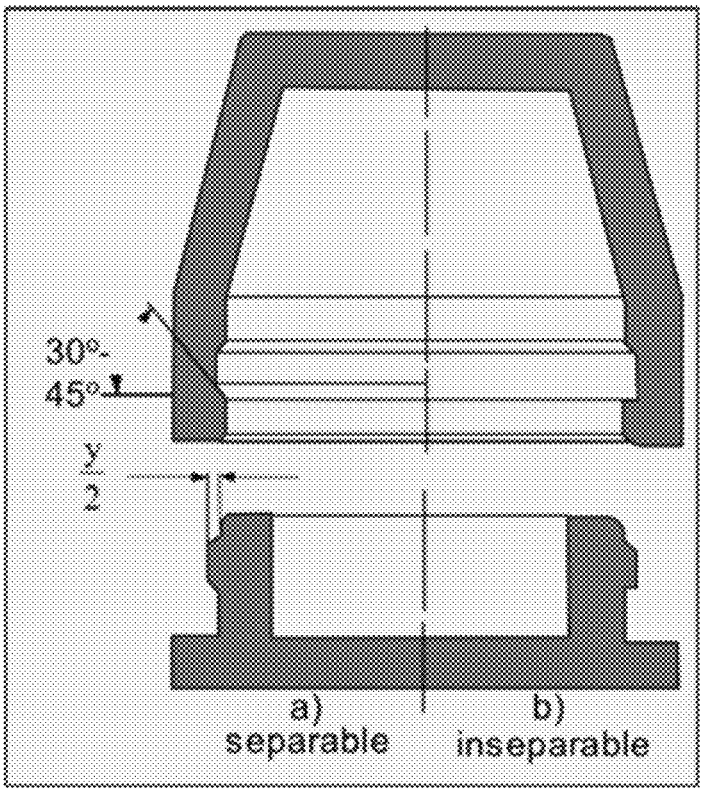
FIG. 17 depicts example separable portion a and inseparable portion b.
Figure 18:
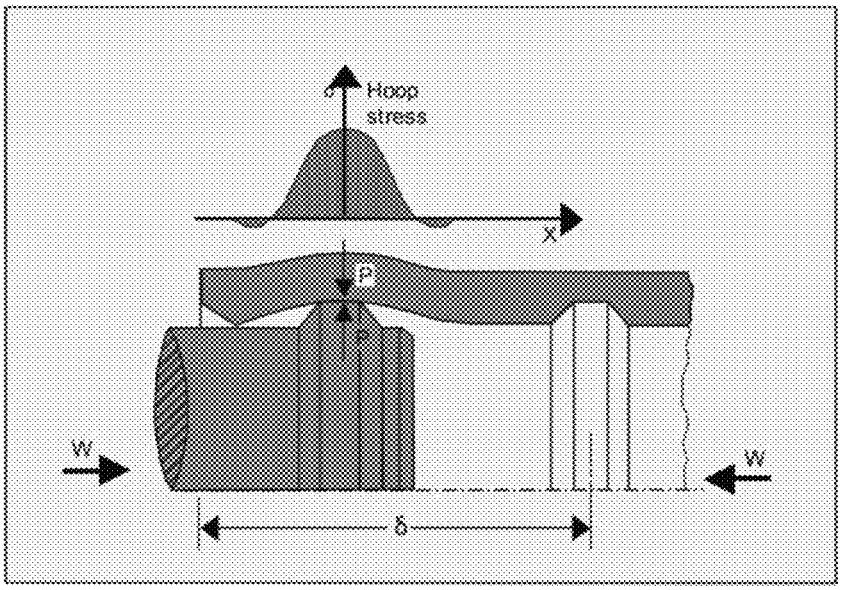
FIG. 18 depicts example hoop stress.
Figure 19:
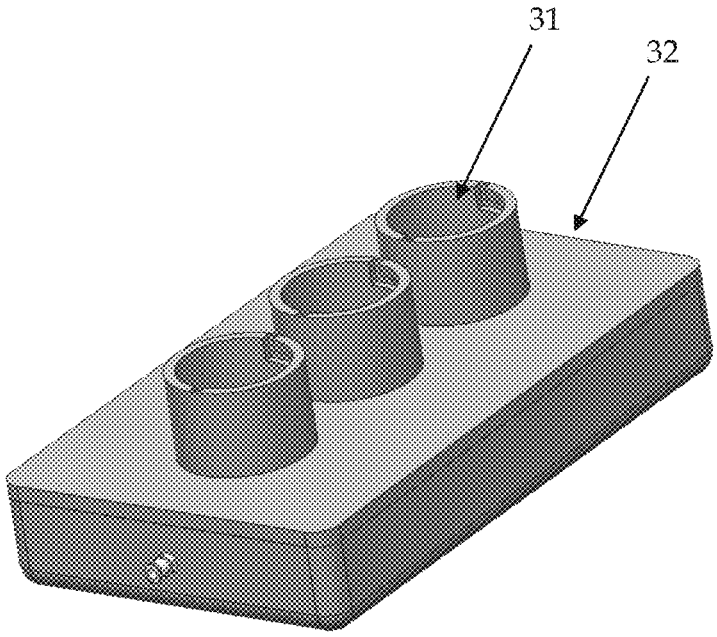
FIGS. 19-21 are perspective views of the seat and mixing chamber of the embodiment of FIG. 13.
Figure 20:
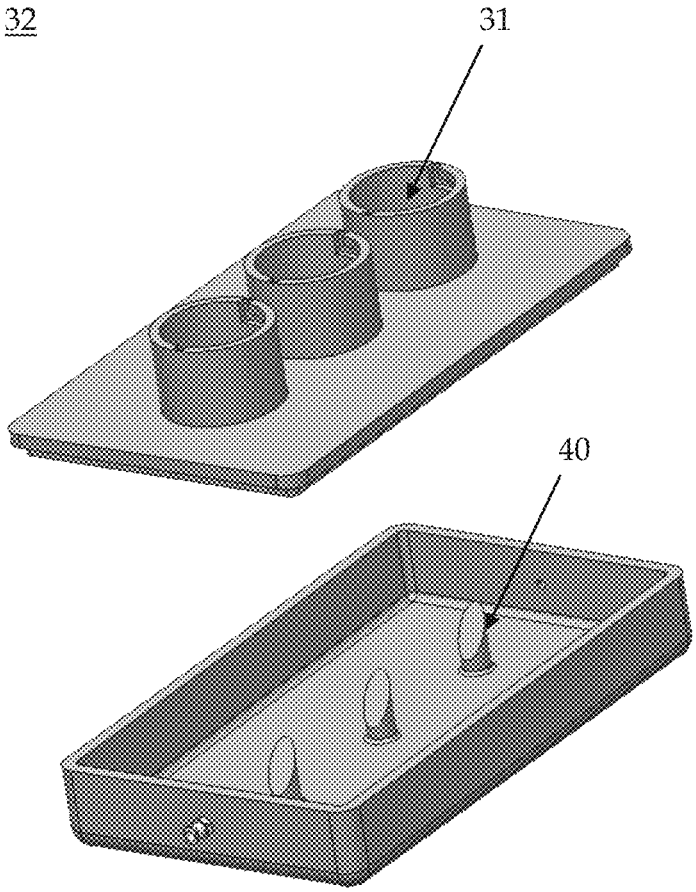
Figure 21:
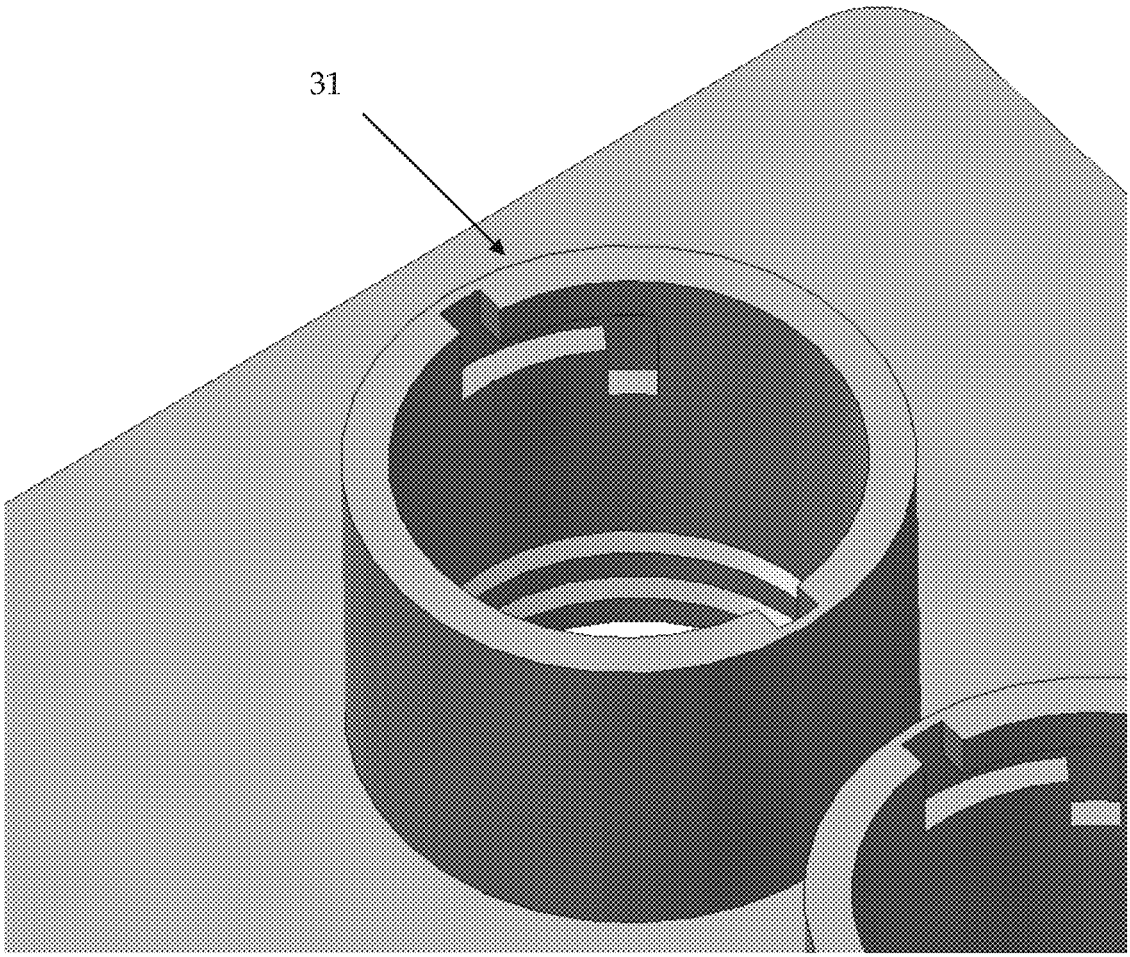
Figure 22:
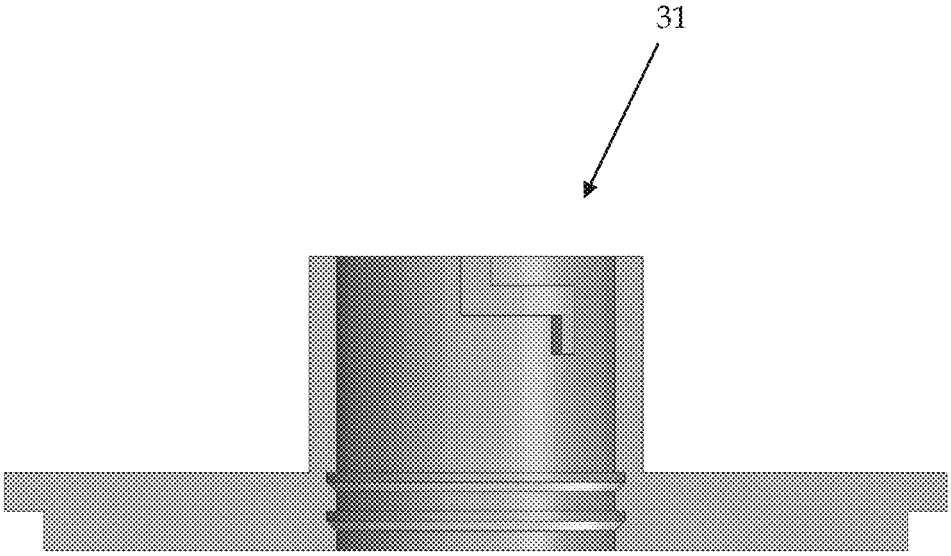
FIGS. 22-27 are cross-sectional views of the seat and mixing chamber of the embodiment of FIG. 13.
Figure 23:
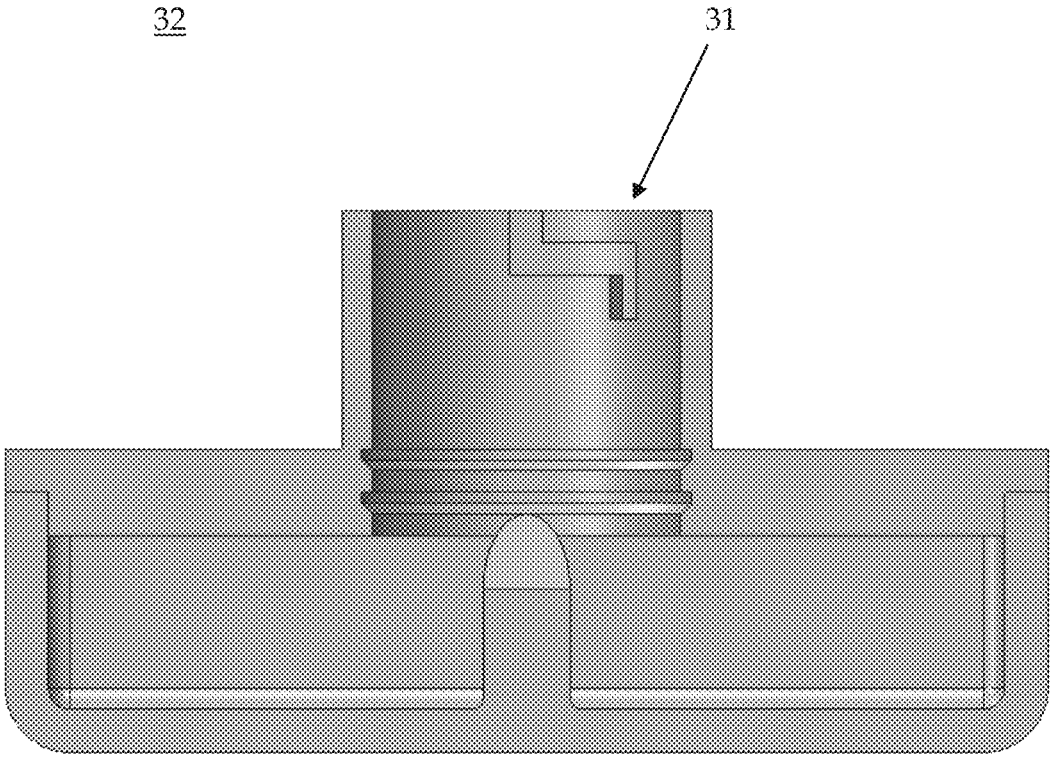
Figure 24:
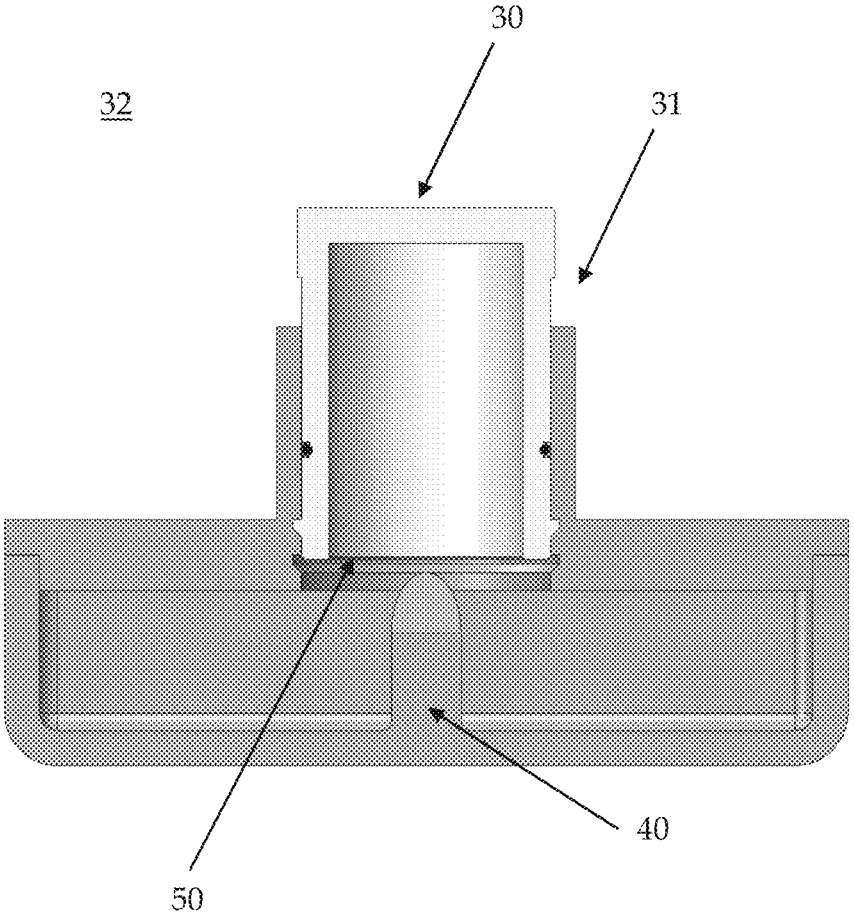
Figure 25:
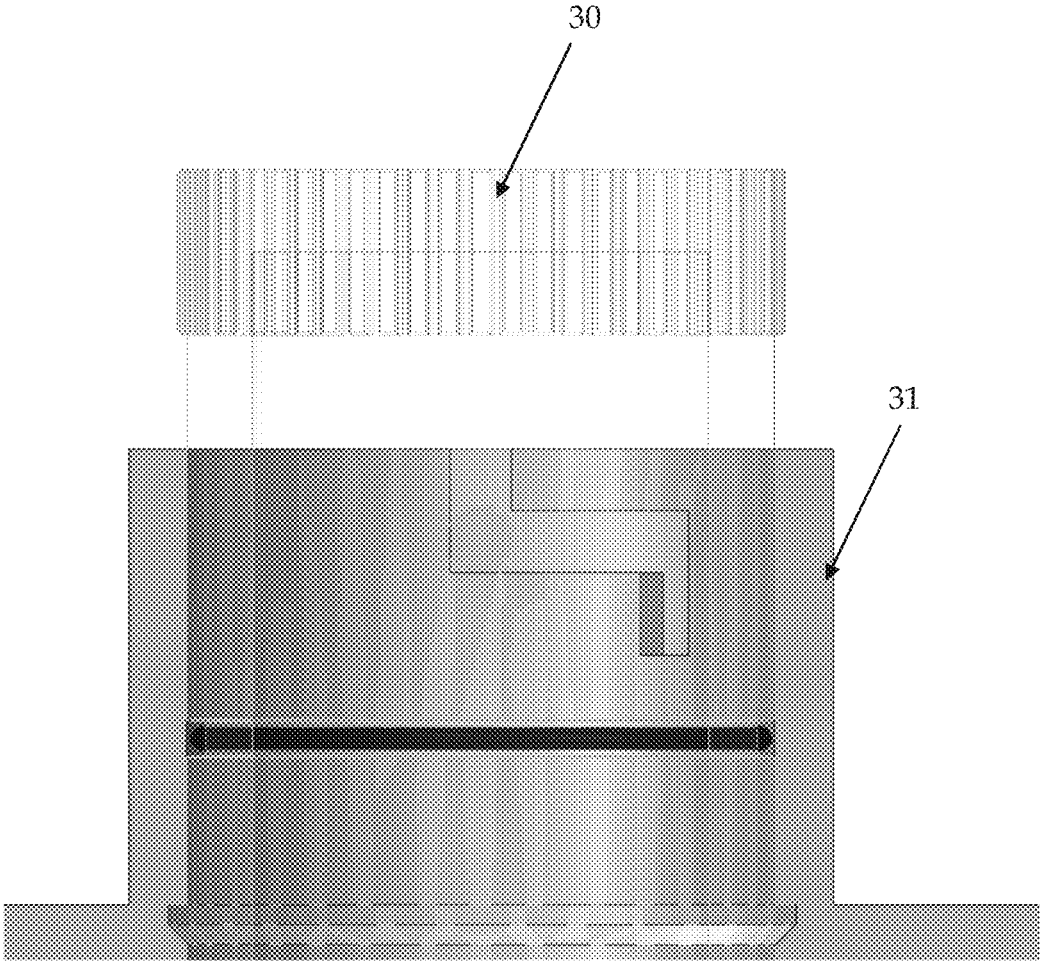

FIGS. 13-27 depict another embodiment of the present disclosure. In this embodiment, the mixing device 10 of FIGS. 13-14, may comprise storage cylinders 30 (shown in detail in FIGS. 15-16) with a pierceable portion 50, a seat 31 and mixing chamber 32, (shown in detail in FIGS. 19-27) and a valve 33 (FIGS. 13-14) for extraction of the mixed medication. In this embodiment the cylinder 30, or the like may be inserted into the seat 31 and piercing posts 40 (FIGS. 14, 20, 23, 24, 26 and 27) may pierce the pierceable portion 50 and release medication from the cylinder 30 into the mixing chamber 32. After which the device 10 may be agitated so that the medication housed therein would mix together. In some embodiments, the mixing chamber 32 may come pre-loaded with a liquid. FIG. 18 depicts example hoop stress placed on the device. FIG. 17 depicts example separable portion a and inseparable portion b.

Figure 28:
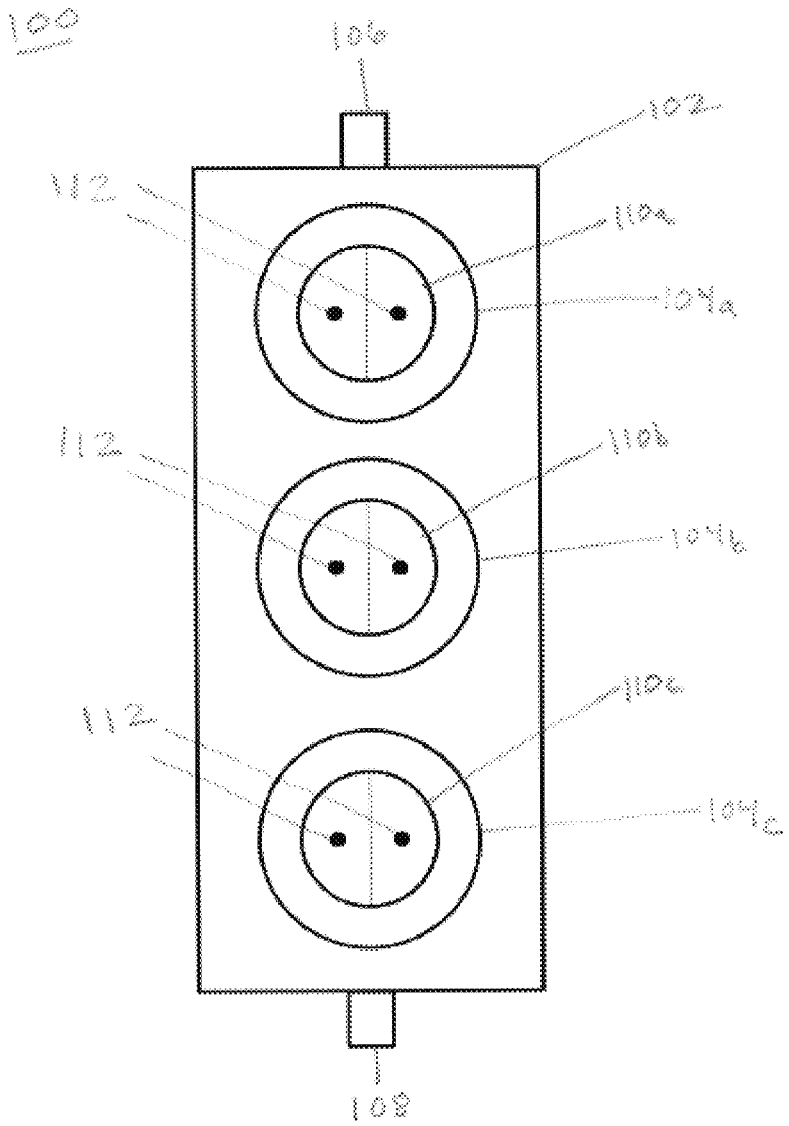
FIG. 28 depicts a front view of a mixing device in accordance with another embodiment of the present disclosure.
Figure 29:
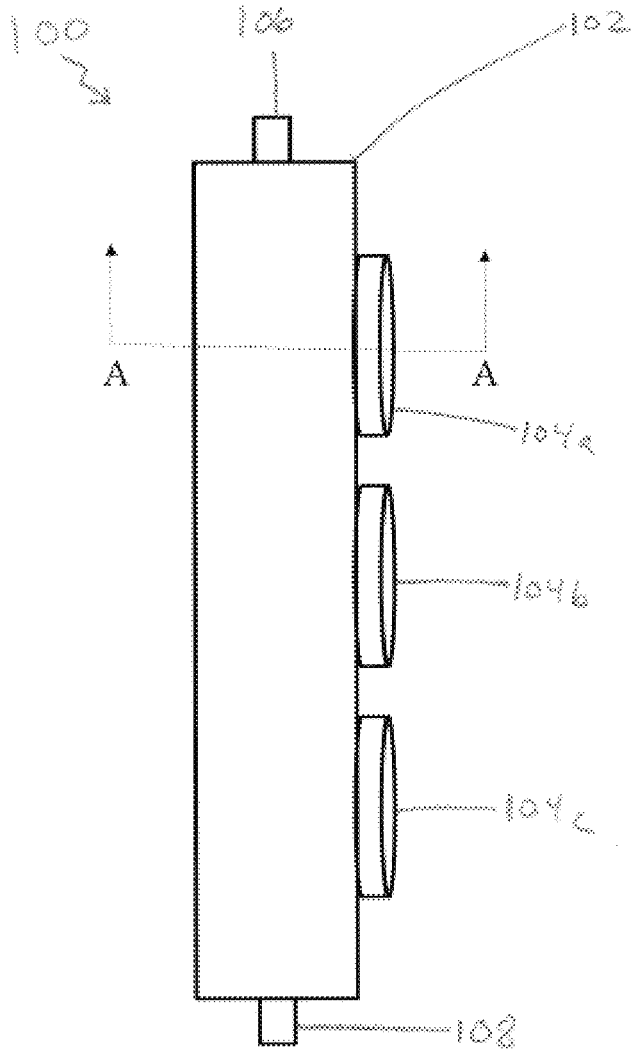
FIG. 29 depicts a side view of a mixing device in accordance with the embodiment of FIG. 28.
Figure 30:
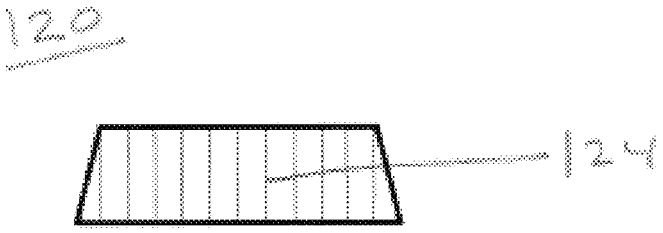
FIGS. 30-32 depict views of a cap in accordance with the embodiment of FIG. 28.
Figure 31:
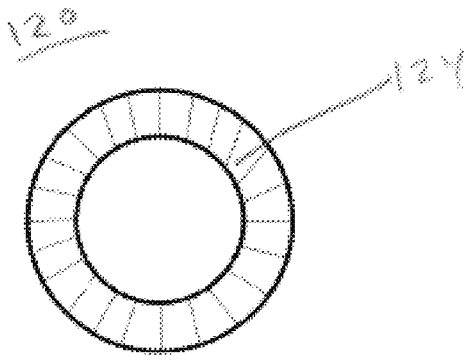
Figure 32:
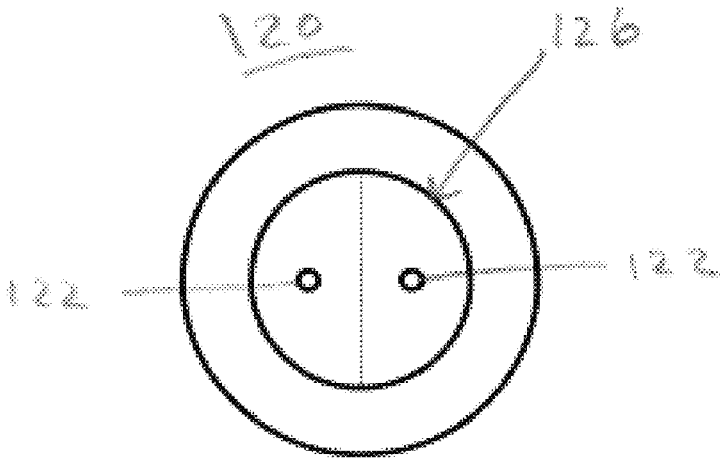
Figure 33:
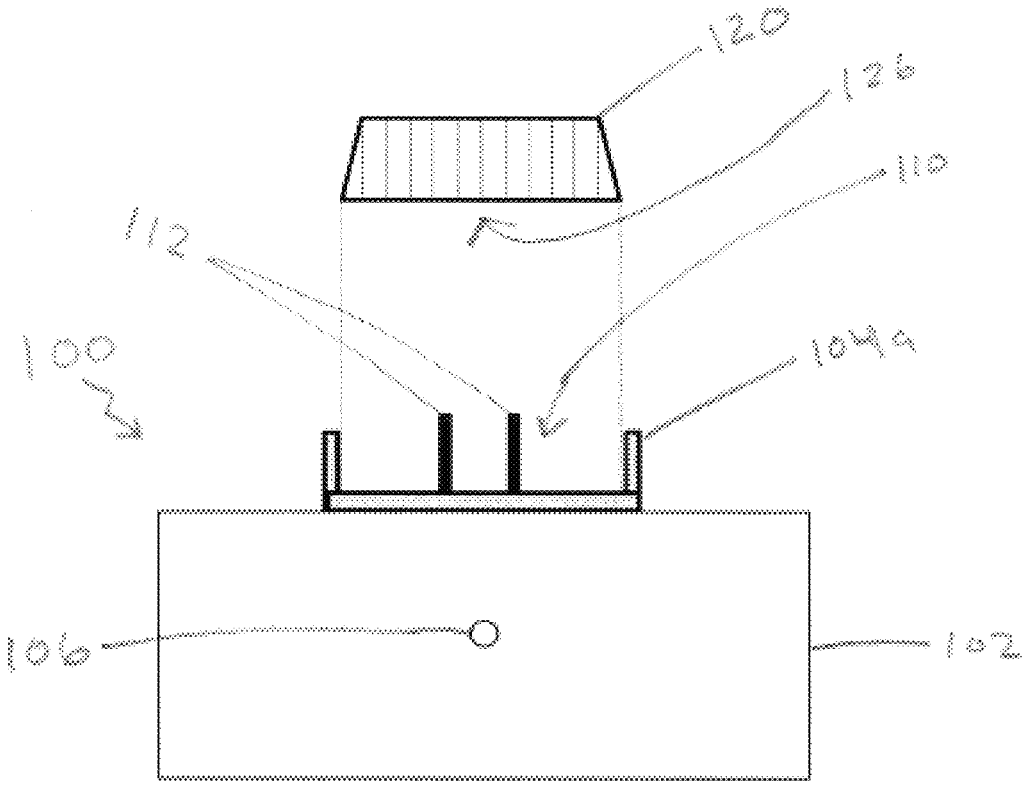
FIGS. 33 and 34 depict cross-sectional views of a mixing device and a cap in accordance with the embodiment of FIG. 28.
Figure 34:
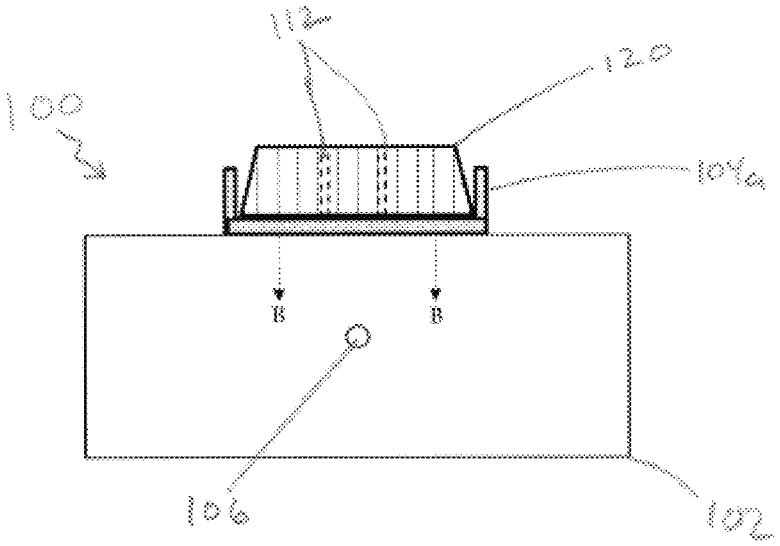
Figure 35:
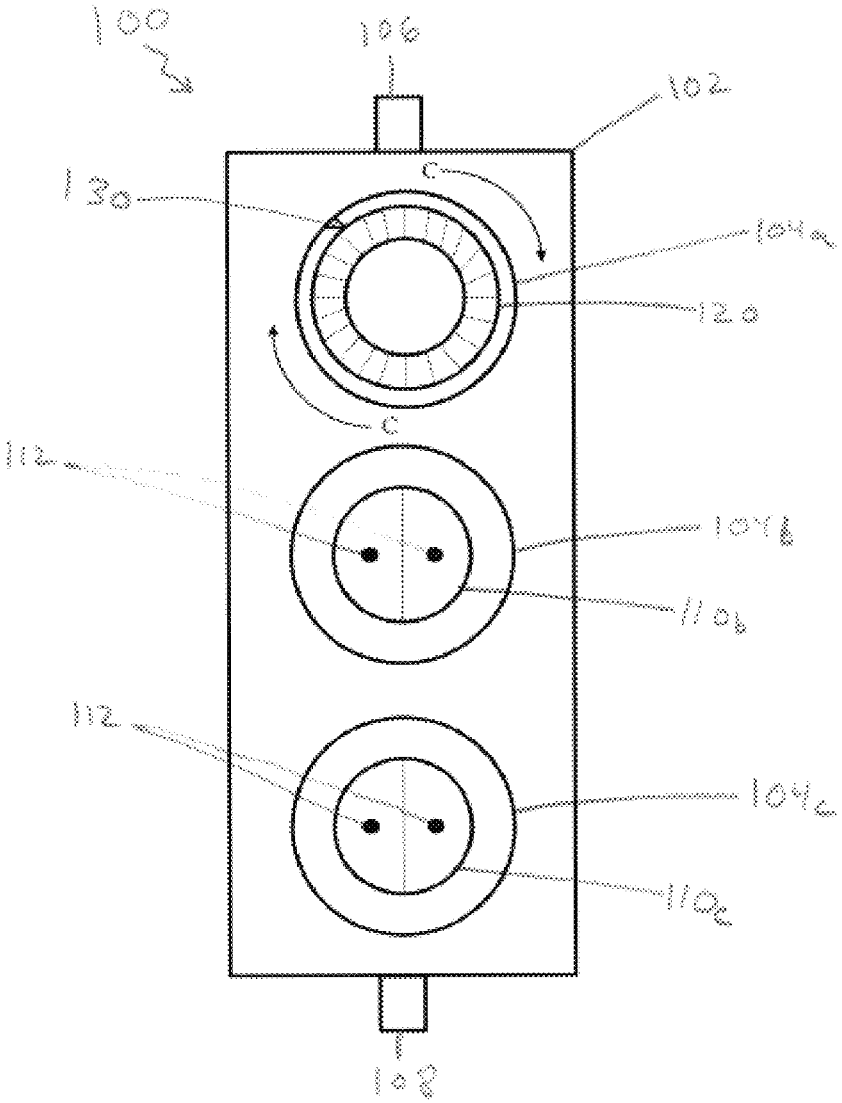
FIG. 35 depicts a front view of a mixing device and a cap in accordance with the embodiment of FIG. 28.

FIGS. 28-35 depict another embodiment of the present disclosure. In particular, FIG. 28 depicts a front view of a mixing device in accordance with this embodiment. FIG. 29 depicts a side view of a mixing device in accordance with this embodiment. FIGS. 30-32 depict views of a cap in accordance with this embodiment. FIGS. 33 and 34 depict cross-sectional views of a mixing device and a cap in accordance with this embodiment. FIG. 35 depicts a front view of a mixing device and a cap in accordance with this embodiment.

With reference to FIGS. 28-35, in exemplary embodiments, a mixing device 100 may be adapted to mix various materials, such as medications, in the interior of a container 102, or the like. A mixing device 100 may comprise a container 102, one or more ports 104*a-c*, an air flow intake 106, an output 108, one or more inputs 110*a* c, one or more protrusions 112, and/or the like. Materials may be received by the container via one or more ports 104*a-c* after coupling with one or more receptacles. The receptacles may be sized and formed to couple with the ports 104*a-c* of the device 100. For example, the receptacles may be one or more caps 120 having an exterior wall defining an interior chamber adapted to accept one or more materials. A device 100 and cap 120 in accordance with exemplary embodiments may generally comprise medical-grade material, such as a material typically used to create syringes for use in the medical industry.

As used herein, the terms "cap," "cartridge," and "cup" may refer to any suitable container or receptacle adapted and shaped to couple with a port 104*a-c* on a mixing device 100 in accordance with exemplary embodiments. A cap 120 may comprise portions adapted to contain a material, such as a medication or chemical ingredient, within the cap 120 until the user activates the cap 120 with the use of the device 100. When the cap 120 is activated, all or a portion of the material stored within the cap 120 may be emptied or transferred into the container 102 for mixing with other materials and eventual administration or distribution. The materials may be stored in pre-measured amounts in one or more caps 120, or the like, and the caps 120 may be adapted to couple with ports 104*a-c*. When the caps 120 containing the materials are coupled with the ports, the device 100 may be configured to allow an amount of the materials to pass into the container 102 upon activation of the caps 120, for example, upon rotation of the caps 120.

In some embodiments, a cap 120 may be installed with a downward pressure and/or twist that will lock a cap 120 in proper position. This process may generally be performed by a manufacturer with a key device that will be fit into two indents or the access portion 122, which may be disposed on the base of the cap. At the delivery site, a clinician may complete the process by further turning the top of the cap 120 to release the drug into the dilute, or the like. In some embodiments, the device 100 may be adapted to make a clicking sound when the cap 120 or the like is being turned.

In exemplary embodiments, caps 120 may be adapted for activation via rotation after coupling with the ports 104*a-c*, or the like. For example, the caps 120 may be adapted to couple with one or more ports 104*a-c* such that when the caps 120 are attached to the ports 104*a-c* and the caps 120 rotated, an amount of the material is released from the cap 120 and deposited or transferred into the container 102. In some embodiments, the entire contents of the caps 120 may be released into the container 102 when the caps 120 are activated or turned. In some embodiments, increasing amounts of material may be deposited or transferred into the container 102 depending upon the degree to which the caps 120 are turned after they are coupled with the ports 104*a-c*. For example, a quarter turn may result in one-quarter, or another pre-measured amount, of the material being deposited in the container, or the like. In some embodiments, the entire contents of the cap 120 may be emptied upon turning the cap 120 a predetermined degree. For example, the device 100 may be configured such that turning the cap 120 ninety degrees when coupled with the port 104 releases the entire contents of the cap, or the like. When the caps 120 are turned or otherwise activated, the ports 104*a-c* may be configured to allow the materials to pass through the ports 104*a-c* into the interior portion of the container 102, or the like. In some embodiments, the ports 104*a-c* may comprise an aperture, opening, channel, or other member adapted to allow the material to pass through from the cap 120 to the interior of the container 102. After materials are deposited within the container 102, a user may mix the materials together by shaking, spinning, or agitating the device 100, or the like.

Processing materials, such as chemical materials or medications for intrathecal pumps, often requires the mixing of these materials within a container. A device 100 in accordance with exemplary embodiments may generally accept various materials and mix them together. One or more ports 104*a-c* may couple with one or more caps 120 in a sealed fashion, whereby the contents of the caps 120 are emptied into the container 102 via the ports 104*a-c* and leaking of the materials and/or removal of the caps is substantially prevented and/or eliminated. Each port 104*a-c* may be adapted to couple with the caps 120, or the like, such that a sealed connection is formed between the container 102 and the caps 120 and the contents of the caps 120 may be emptied into the container 102, substantially or completely eliminating any leaking of the materials. In operation, when all or a portion of the contents of the caps 120 are emptied or transferred into the container 102, the container 102 may then be agitated, shaken, stirred, roused, spun, and/or the like, either manually by the user or with an external device, the mixing device 100 to mix the contents sufficiently in accordance with mixing requirements of each medication.

Each medication or category of medications may have instructions on the length of time and/or the vigor at which the container 102 should be shaken or otherwise agitated to produce the resulting composition, or the like. Alternatively, all medications made or mixed by the device 100 may comprise a standard set of mixing requirements and/or suggestions.

A mixing device 100 may comprise a container 102 with a substantially hollow interior for storage of a substance such as a medication, or the like. In some embodiments, the container 102 may comprise a hollow area surrounded by sidewalls. In some embodiments, additional mechanical elements such as stirring rods, filters, or impellers may be present within the interior of the container 102 to aid in the mixing and/or filtering of any materials positioned within the container 102. The shape of the container 102 may be generally be formed to allow a user to easily grip the container 102 and shake it, thereby mixing its contents. Although the container 102 is depicted as substantially rectangular in shape, any shape suitable for embodiments of the present disclosure is contemplated. For example, a square, oval, triangle, or circle shape, and/or the like, may be used. A container 102 may be sized to store enough material and/or medication suitable for the desired function, such as intrathecal infusion therapy, or the like. In some embodiments, a medication must be made by the device 100 a predetermined time before administration.

In some embodiments, a mixing device 100 may be manufactured to be pre-filled or partially pre-filled with a material, such as a diluent, or the like. For example, in one embodiment, the container 102 may be partially pre-filled with a saline solution, such as 0.9% saline, or the like. In exemplary embodiments, the device 100 may be a closed system. The function of the container 102 is generally to accept materials from caps 120, or the like, mix them together, and administer them through an output. The output 120 may be a standard medical output used to connect and establish material and/or fluid communication between different components, such as a Luer taper. Luer tapers may include locking and slipping connections, manufactured and sold under the trade names "Luer-Lok" and "Luer-Slip," respectively. Luer tapers, or the like, are widely used to connect syringes to medical instruments, such as needles and cannulas, and to connect medical conduits to one another. A Luer taper is a standardized system of small-scale fluid fittings used for making leak-free connections between a male-taper fitting and its mating female part. The Luer taper may be used to make leak-free connections between medical and laboratory instruments, including hypodermic syringe tips and needles or stopcocks and needles. Luer taper receptacles, or the like, may comprise a standard configuration that may allow different sizes and types of instruments to be connected to the same receptacle. In some embodiments, an output 108 may only allow fluid to exit the container 108. An output 108 may comprise a filter to ensure materials, sediment, and/or the like, that are not intended to be administered to the patient do not pass through the output 108. For example, an output 108 may comprise a 0.22 micron filter, or the like.

A mixing device 100 may also comprise an air flow intake 106, or the like. An air flow intake 106 may be an opening or aperture formed to allow air to pass into the container, thereby allowing material held within the container 102 to exit the container 102 through the output 108 in a substantially smooth manner. In some embodiments, the air flow intake 106 may only allow air to flow inward, not out of the container. An air flow intake 106 may also comprise a filter for filtering or substantially filtering contaminants out of the air, to reduce and/or eliminate the likelihood that the materials within the container 102 will be contaminated or changed by the air entering the air flow intake 106. The air intake 106 may generally have a cylindrical or tube shape, or any shape suitable for accepting air and improving the flow of material from the container 102 out of the output 108, or the like.

As depicted in the figures the various components are mechanical elements. It is contemplated that electrical, electromechanical, computerized, automated components, and/or the like, may also be utilized. The container 102, air flow intake 106, ports 104*a-c*, and/or output may comprise electrical components and/or a pump, wherein the materials may be mixed and/or distributed utilizing electrical components, or the like. For example, an electrical mixer and/or pump may be disposed within the container 102 and may mix and/or distribute the material upon the press of a button or other suitable activation means, such as a remote control, a smartphone, or the like. In some embodiments, the mixing and or distribution may be partially or completely automated.

Figure 26:
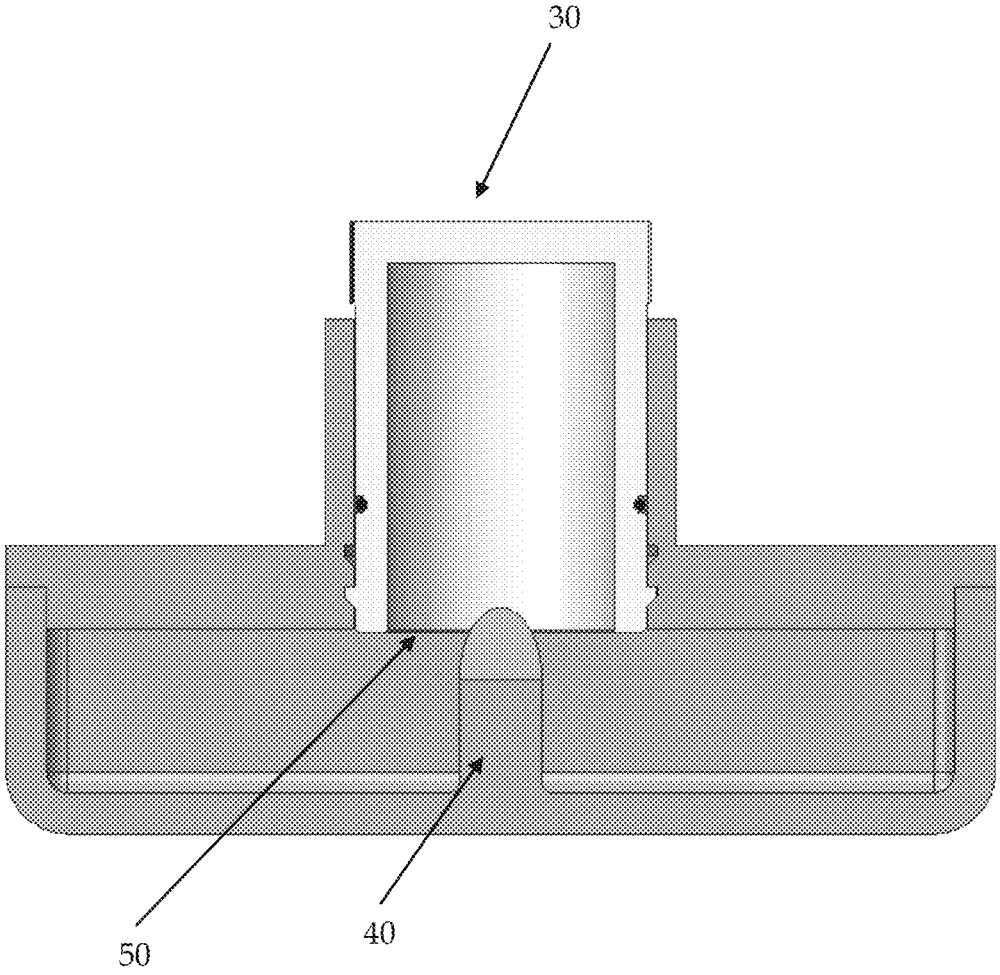
Figure 27:
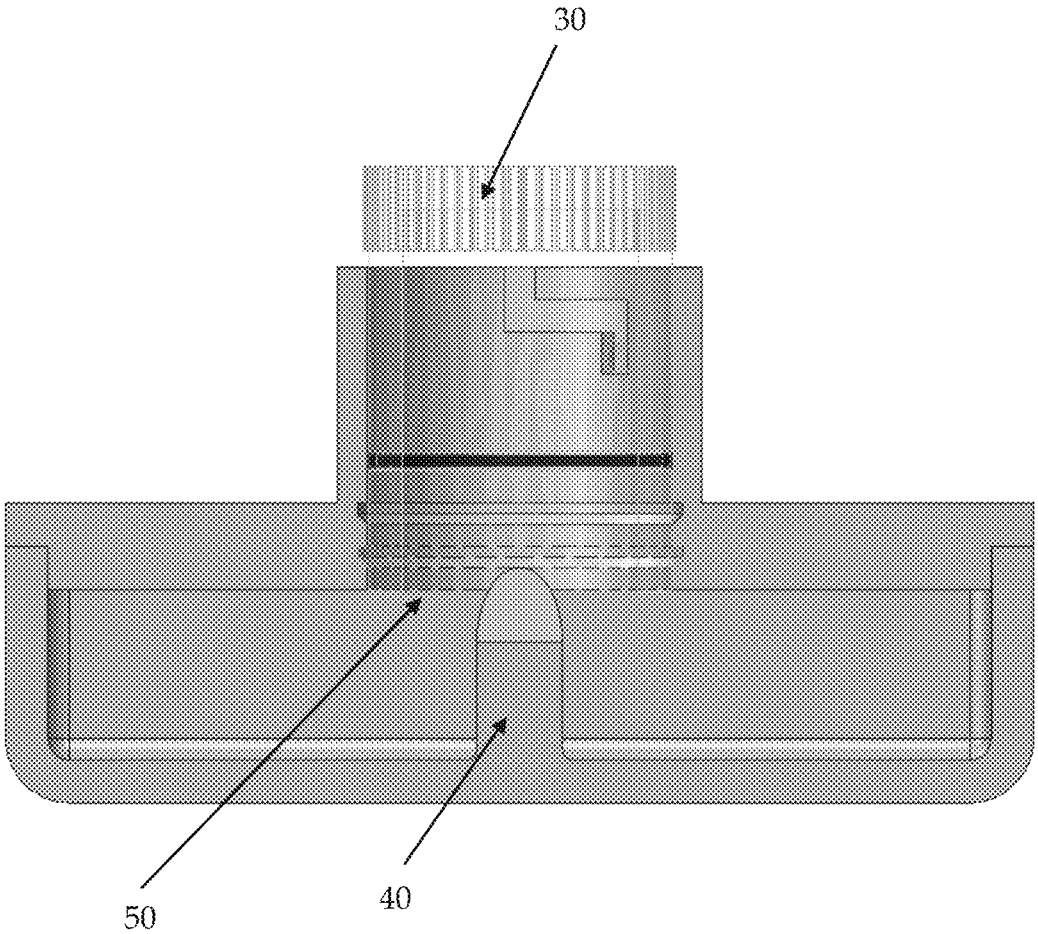

Although three ports 104*a*, 104*b*, 104*c* are depicted in FIG. 26, any suitable number of ports consistent with the present disclosure are contemplated. For example, a container may comprise 1, 2, 3, 5, 7, or the like, ports 104 *a-c*. Each port 104*a-c* may accept a cap 120 containing one or more materials to be mixed. For example, three caps 120 may comprise different materials and may be attached to the ports 104*a-c* for distribution into the container 102. Each cap 120 may be completely emptied into the container 102 or partially emptied into the container depending upon which degree the caps 120 are turned after engaging with the ports 104 *a-c*. After the desired amounts or total amounts of material are deposited in the container 102, the container may be shaken or otherwise agitated to mix the various ingredients and form the desired medication to be administered to a patient, or the like, via the output 108. In some embodiments, the container 102 may be pre-filled with a solution and when the caps 120 are twisted, the materials, drugs, or the like may be released into the solution for mixing. After shaking the device 100 the resulting medication may be formed to be distributed to the patient.

In the figures, the ports 104*a-c* are shown as raised from the surface of the container 102, however the ports may be positioned entirely or partially below the surface of the container 102, or the like. Although a back surface of the container 102 opposite the ports 104*a-c* is depicted as substantially flat in FIG. 27, it is contemplated that the surface may include curves, contours, and/or ergonomic shapes to make the device easier to hold for the user. Additional straps, or the like, may also be included to help secure the device 100 to a user's hand and prevent it from slipping out of the hand while it is being shaken. The ports 104*a-c* may generally be of a shape and size suitable for coupling with one or more caps 120. In some examples, if the caps 120 are substantially round, the ports 104*a-c* may also be substantially round. The caps 120 and/or the ports 104*a-c* may be of any suitable shape in accordance with embodiments of the present disclosure. In some embodiments the caps 120 may comprise a frustum shape, a cone shape, and/or the like.

In exemplary embodiments the ports 104*a-c* may comprise one or more inputs 110*a-c*. The inputs 110*a-c* may comprise a portion of the ports 104*a-c* that couple or coordinate with the caps 120, or the like, and allow the material stored therein to pass through and/or direct the material through the ports 104*a-c* into the container 102. The inputs 110*a-c* may comprise a slid able door, panel, or other barrier that maintains a tight seal with the caps 120 when the caps 120 are coupled with the ports 104*a-c*, thereby preventing the material stored within the container 102 from leaking out. In some embodiments, the inputs 110*a-c* may comprise an aperture, opening, tunnel, channel, conduit, and/or the like that allows material to pass from the caps 120 into the container 102 when activated, for example, by turning the caps a predetermined degree. In some embodiments, the materials inside the caps 120 may simply be released into the container 102 via one or more apertures, without the use of any doors or mechanical means. In some embodiments, the inputs 110*a-c* may comprise one or more protrusions 112. In accordance with exemplary embodiments, the container 102, caps 120, and/or any component of the device 100 may comprise a filter, or the like, to ensure the purity and/or integrity of the compositions to be administered, or the like.

In exemplary embodiments, the device 100 may comprise one or more protrusions 112. A protrusion 112 may be adapted to couple with a portion of a cap 120 to allow material from the cap 120 to rotate and release its contents into the container 102. For example, a protrusion 112 may be a prong with a sharp end or a dull end configured to couple with an access portion 122 on the base 126 of a cap 120. A base 126 may comprise a lower portion of a cap 120 adapted to couple with a port 104*a-c* of the device 100. An access portion 122 of a cap may be a structure or opening formed to couple with a protrusion 112 of the device 102.

In some embodiments, the access portions 122 may comprise apertures that, when accessed by the protrusions 112, release a predetermined amount or the entire amount of the material stored within a cap 120 into the container 102. In some embodiments, the base 106 may be completely or partially covered with a material that is adapted to be pierced or otherwise accessed by protrusions 112 on the device 100. For example, in some embodiments, the base 126 of a cap 120 may comprise foil, plastic, or some other material that can be accessed with a protrusion 112. A protrusion 112 may comprise a proximal end positioned on or in the cap 120 and a distal end adapted to enter a portion of a cap 120 and release at least a portion of the contents stored therein. In some embodiments, the protrusions 112 may activate the access portions 122 of a cap 120 and upon rotation of the cap 120 by the user, one or more portions of the cap 120, such as slidable doors, or the like, may be opened. In some embodiments the protrusions may function as a key adapted to unlock the contents of the cap 120, or the like.

In exemplary embodiments of the present disclosure, a cap 120 may comprise a grip 124 portion. A grip 124 may comprise one or more flattened portions or grooves to allow a user to more easily turn the cap 120 when it is engaged with a device 100. In some embodiments, a grip 124 may comprise a non-slip material such as a rubber to provide the user a secure grip on the cap, or the like. In some embodiments, the device 100 may comprise a mechanism that prevents the caps 120 from being removed once they are engaged with the device 100. In such embodiments, the device 100 will be a single-use device. In some embodiments, the device 100 may comprise a lock 130 to prevent accidental counter rotation and/or removal of the caps 120 from the device 100 after the caps 120 are coupled with the ports 104. In some embodiments, the caps 120 may be intended for one-time use.

Referring to FIGS. 34-35, in operation, the user may select the appropriate caps 120 containing the appropriate ingredients and couple them or place them on the ports 104*a* in the direction of arrow B (FIG. 34). Once the caps are engaged on the ports 104*a*, the caps may then be rotated in the direction of arrows C (FIG. 35) to activate the cap 120 and release an amount of the ingredient or all of the ingredient contained within the cap into the container 102. The device 100 may then be shaken such that the ingredients and/or materials are mixed together to be distributed and/or administered via an output 108. In some embodiments each device 100 and/or cap 120 may comprise a tracking indicator, such as a barcode a QR code, and/or the like, that may be scanned to track inventory and/or compliance with the proper methods of making a medication and/or administering a medication. The scanned information may become part of a patient's medical record, or the like.

In some embodiments, a mixing device may comprise a size suitable for mixing medication. For example, the outer diameter may be 3.786" and the height, when fully collapsed may be 3.3".

Hereinabove, the present invention has been described with reference to exemplary embodiments thereof. All exemplary embodiments and conditional illustrations disclosed in the present disclosure have been described to intend to assist in the understanding of the principle and the concept of the present invention by those skilled in the art to which the present invention pertains. Therefore, it will be understood by those skilled in the art to which the present invention pertains that the present invention may be implemented in modified forms without departing from the spirit and scope of the present invention.

In the disclosure and the claims, terms such as "first", "second", "third", "fourth", and the like, if any, will be used to distinguish similar components from each other and be used to describe a specific sequence or a generation sequence, but is not necessarily limited thereto. It will be understood that these terms are compatible with each other under an appropriate environment so that exemplary embodiments of the present invention set forth herein may be operated in a sequence different from a sequence illustrated or described herein. Likewise, in the case in which it is described herein that a method includes a series of steps, a sequence of these steps suggested herein is not necessarily a sequence in which these steps may be executed. That is, any described step may be omitted and/or any other step that is not described herein may be added to the method.

In addition, in the disclosure and the claims, terms such as "left", "right", "front", "rear", "top", "bottom", "over", "under", and the like, if any, do not necessarily indicate relative positions that are not changed, but are used for explanation. It will be understood that these terms are compatible with each other under an appropriate environment so that exemplary embodiments of the present invention set forth herein may be operated in a direction different from a direction illustrated or described herein. A term "connected" used herein is defined as being directly or indirectly connected in an electrical or non-electrical scheme. Here, targets described as being "adjacent to" each other may physically contact each other, be close to each other, or be in the same general range or region, in a context in which the above phrase is used. Here, a phrase "in an exemplary embodiment" means the same exemplary embodiment, but is not necessarily limited thereto.

In addition, in the disclosure and the claims, terms such as "connected", "connecting", "linked", "linking", "coupled", "coupling", and the like, and various modifications of these terms may be used as the meaning including that one component is directly connected to another component or is indirectly connected to another component through the other component.

In addition, terms "module" and "unit" for components used in the present disclosure are used only in order to easily make the disclosure. Therefore, these terms do not have meanings or roles that distinguish from each other in themselves.

In addition, terms used in the present disclosure are for explaining exemplary embodiments rather than limiting the present invention. In the present disclosure, a singular form includes a plural form unless explicitly described to the contrary. Components, steps, operations, and/or elements mentioned by terms "comprise" and/or "comprising" used in the disclosure do not exclude the existence or addition of one or more other components, steps, operations, and/or elements.

Hereinabove, the present invention has been described with reference to exemplary embodiments thereof. All exemplary embodiments and conditional illustrations disclosed in the present disclosure have been described to intend to assist in the understanding of the principle and the concept of the present invention by those skilled in the art to which the present invention pertains. Therefore, it will be understood by those skilled in the art to which the present invention pertains that the present invention may be implemented in modified forms without departing from the spirit and scope of the present invention.

Therefore, exemplary embodiments disclosed herein should be considered in an illustrative aspect rather than a restrictive aspect. The scope of the present invention should be defined by the claims rather than the above-mentioned description, and equivalents to the claims should be interpreted to fall within the present invention. While the foregoing is directed to embodiments of the present invention, other and further embodiments of the invention may be devised without departing from the basic scope thereof. For example, although numerous embodiments having various features have been described herein, combinations of such various features in other combinations not discussed herein are contemplated within the scope of embodiments of the present invention.

What is claimed is:

1. Apparatus for facilitating the sterile compounding of medications, comprising:

a. a first chamber;

b. a second chamber, said first and second chambers slidably coupled to each other such that they can be telescoped inwardly and outwardly relative to each other, to contracted and expanded states, respectively, said first and second chambers adapted to remain connected together in said expanded state, wherein protrusions extending from an inner surface of the first chamber engage recesses disposed in an outer surface of the second chamber thereby slidably coupling the first chamber and the second chamber;

c. a plurality of compartments within said first chamber, said compartments adapted to receive compounding medications to be mixed prior to administration to a patient;

d. a blocking portion in said second chamber that bears upon and closes said compartments when said chambers are in said contracted state so that said compounding medications cannot mix with each other, said blocking portion uncovering said compartments when said chambers are in said expanded state;

e. a mixing compartment formed between said first and second chambers when said chambers are in said expanded state, to thereby facilitate the mixing of said medications; and f. an outlet through which said medications can be retrieved after mixing while said first and second chambers are connected together.

2. The apparatus of claim 1 wherein said first and second chambers are substantially cylindrical.

3. The apparatus of claim 2 wherein said chambers are adapted to telescope outwardly by first rotating said chambers relative to each other.

4. The apparatus of claim 1 wherein said outlet comprises a Luer port.

5. The apparatus of claim 4 further comprising an inlet through which air can be drawn into said mixing compartment when said chambers are in said expanded state.

6. Apparatus for facilitating the sterile compounding of medications, comprising:

a. a plurality of containers adapted to hold compounding medications to be mixed prior to administration to a patient;

b. a mixing chamber having a plurality of receptacles, each of said receptacles (i) adapted to receive one of said plurality of containers and (ii) having at least one projection adapted to pierce a portion of said one container when said container is inserted into said receptacle, wherein said mixing chamber has recesses disposed in an inner surface of each of the plurality of receptacles and wherein each of said plurality of containers has protrusions extending from an outer surface thereof;

c. said mixing chamber adapted to receive said compounding medications when said containers are inserted into said receptacles and to facilitate the mixing thereof prior to administration to said patient, wherein said containers and receptacles are substantially cylindrical, and said projection is configured such that said containers are adapted to be rotated in said receptacles in order to release a metered amount of said compounding medications into said mixing chamber; and d. an outlet port in said mixing chamber through which said medications can be retrieved after mixing.

7. The apparatus of claim 6, wherein said receptacles and containers are configured such that said containers must overcome a stress resistance in order to be inserted into said receptacles.

8. The apparatus of claim 6 wherein said projection includes a wedge-shaped profile.

9. The apparatus of claim 6 wherein each of said projections comprises at least two protrusions adapted to pierce said portion of each container.

10. The apparatus of claim 1, wherein said plurality of compartments are formed as a unitary, non-separable structure.

* * * * *